US007799411B2

(12) United States Patent
Ostendorf et al.

(10) Patent No.: US 7,799,411 B2
(45) Date of Patent: Sep. 21, 2010

(54) ABSORBENT PAPER PRODUCT HAVING NON-EMBOSSED SURFACE FEATURES

(75) Inventors: Ward William Ostendorf, West Chester, OH (US); Rebecca Howland Spitzer, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 193 days.

(21) Appl. No.: 11/924,714

(22) Filed: Oct. 26, 2007

(65) Prior Publication Data

US 2008/0102250 A1 May 1, 2008

Related U.S. Application Data

(60) Provisional application No. 60/855,688, filed on Oct. 31, 2006.

(51) Int. Cl.
*B32B 3/00* (2006.01)
*B32B 7/02* (2006.01)
*D21H 15/02* (2006.01)

(52) U.S. Cl. ..... 428/212; 428/153; 428/154; 428/156; 428/532; 428/534; 428/535; 162/109

(58) Field of Classification Search ..... 428/152, 428/153, 154, 156, 166, 218, 212, 532–535; 162/109, 111, 123
See application file for complete search history.

(56) References Cited

U.S. PATENT DOCUMENTS 1,337,254 A * 4/1920 Muench ..... 428/167
1,536,533 A 5/1925 Sheehan
1,716,866 A 6/1929 Sherman
3,034,180 A 5/1962 Greiner et al.
3,240,657 A 3/1966 Hynek
3,322,617 A 5/1967 Osborne
3,350,260 A 10/1967 Johnson
3,549,742 A 12/1970 Benz
3,834,983 A 9/1974 Conway et al.
3,994,771 A 11/1976 Morgan, Jr. et al.
4,119,543 A * 10/1978 Lawson et al. ..... 210/496
4,208,459 A 6/1980 Becker et al.
4,239,065 A 12/1980 Trokhan
4,514,345 A 4/1985 Johnson et al.
4,528,239 A 7/1985 Trokhan
4,529,480 A 7/1985 Trokhan
4,541,895 A 9/1985 Albert
4,637,859 A 1/1987 Trokhan
4,740,409 A 4/1988 Lefkowitz
5,066,532 A 11/1991 Gaisser (Continued)

FOREIGN PATENT DOCUMENTS

CA 879436 8/1971

(Continued)

*Primary Examiner*—Donald Loney
(74) *Attorney, Agent, or Firm*—Roddy M. Bullock

(57) ABSTRACT

A cellulosic fibrous structure product having one or more plies. At least one of the plies has one or more unembossed areas, and the one or more unembossed area has a macroscopic first surface and a macroscopic second surface. The fibrous structure product also has a first wall which forms vertices with the first surface and the second surface. In addition, the first wall and the second surface form a top side wall angle of from about 90° to about 140°.

14 Claims, 16 Drawing Sheets

U.S. PATENT DOCUMENTS 5,077,116 A 12/1991 Lefkowitz
5,098,522 A 3/1992 Smurkoski et al.
5,245,025 A 9/1993 Trokhan et al.
5,260,171 A 11/1993 Smurkoski et al.
5,275,700 A 1/1994 Trokhan
5,328,565 A 7/1994 Rasch et al.
5,330,604 A 7/1994 Allum et al.
5,334,289 A 8/1994 Trokhan et al.
5,364,504 A 11/1994 Smurkoski et al.
5,429,686 A 7/1995 Chiu et al.
5,431,786 A 7/1995 Rasch et al.
5,443,691 A 8/1995 Phan et al.
5,462,642 A 10/1995 Kajander
5,496,624 A 3/1996 Stelljes et al.
5,500,277 A 3/1996 Trokhan et al.
5,514,523 A 5/1996 Trokhan et al.
5,527,428 A 6/1996 Trokhan et al.
5,529,664 A 6/1996 Trokhan et al.
5,549,790 A 8/1996 Phan
5,554,467 A 9/1996 Trokhan et al.
5,556,509 A 9/1996 Trokhan et al.
5,566,724 A 10/1996 Trokhan et al.
5,580,423 A 12/1996 Ampulski et al.
5,609,725 A 3/1997 Phan
5,624,790 A 4/1997 Trokhan et al.
5,628,876 A 5/1997 Ayers et al.
5,629,052 A 5/1997 Trokhan et al.
5,637,194 A 6/1997 Ampulski et al.
5,672,248 A 9/1997 Wendt et al.
5,674,663 A 10/1997 McFarland et al.
5,679,222 A 10/1997 Rasch et al.
5,693,187 A 12/1997 Ampulski et al.
5,709,775 A 1/1998 Trokhan et al.
5,714,041 A 2/1998 Ayers et al.
5,718,806 A 2/1998 Trokhan et al.
5,741,402 A 4/1998 Trokhan et al.
5,744,007 A 4/1998 Trokhan et al.
5,746,887 A 5/1998 Wendt et al.
5,776,311 A 7/1998 Trokhan et al.
5,795,440 A 8/1998 Ampulski et al.
5,804,036 A 9/1998 Phan et al.
5,814,190 A 9/1998 Phan
5,817,377 A 10/1998 Trokhan et al.
5,820,730 A 10/1998 Phan et al.
5,837,103 A 11/1998 Trokhan et al.
5,846,379 A 12/1998 Ampulski et al.
5,885,421 A 3/1999 Ensign et al.
5,893,965 A 4/1999 Trokhan et al.
5,900,122 A 5/1999 Huston
5,906,710 A 5/1999 Trokhan
5,948,210 A 9/1999 Huston
5,954,097 A 9/1999 Boutilier
5,972,813 A 10/1999 Polat et al.
6,017,417 A 1/2000 Wendt et al.
6,039,839 A 3/2000 Trokhan et al.
6,165,585 A 12/2000 Trokhan
6,197,154 B1 3/2001 Chen et al.
6,398,910 B1 6/2002 Burazin et al.
6,436,240 B1 8/2002 Jeffrey
6,464,831 B1 10/2002 Trokhan et al.
6,576,090 B1 6/2003 Trokhan et al.
6,576,091 B1 6/2003 Cabell et al.
7,094,320 B1 8/2006 Phan
2005/0133176 A1 6/2005 Vinson et al.

FOREIGN PATENT DOCUMENTS

EP 1217106 6/2002
GB 1212473 A 11/1970
GB 2254288 10/1992
WO WO 9114558 10/1991
WO WO 98/00604 A 1/1998
WO WO 9914425 3/1999
WO WO 02/41815 A 5/2002

* cited by examiner

ABSORBENT PAPER PRODUCT HAVING NON-EMBOSSED SURFACE FEATURES

CROSS-REFERENCE TO RELATED APPLICATIONS

This application claims the benefit of U.S. Provisional Application No. 60/855,688 filed on Oct. 31, 2006, the substance of which is incorporated herein by reference.

FIELD OF THE INVENTION

This invention pertains to a cellulosic fibrous structure product having highly defined, non-embossed surface features formed during the papermaking process.

BACKGROUND OF THE INVENTION

Cellulosic fibrous structures are a staple of everyday life. Cellulosic fibrous structures are used as consumer products for paper towels, toilet tissue, facial tissue, napkins, and the like. The large demand for such paper products has created a demand for improved aesthetics, visual effects, and other benefits on the surface of the product, and as a result, improved methods of creating these visual effects.

Some consumers prefer cellulosic fibrous structures that have a softer, three-dimensional appearance, or effect, when they look at the surface of the structure. At the same time, consumers desire products that appear to have a high caliper with aesthetically pleasing decorative patterns exhibiting a high quality cloth-like appearance. Such attributes, however, must be provided without sacrificing the other desired functional qualities of the product such as softness, absorbency, drape (flexibility) and bond strength.

Cellulosic fibrous structures are known in the art of consumer products. Such products typically have one or more plies. In a multi-ply embodiment the plies are often superimposed in face-to-face relationship to form a laminate. It is known in the art to emboss the surface of the cellulosic fibrous structure. However, embossing tends to impart a particular aesthetic appearance to the cellulosic fibrous structure at the expense of other properties of the cellulosic fibrous structure that are desirable to the consumer. This results in a trade-off between aesthetics and certain other desired attributes.

More particularly, embossing disrupts bonds between fibers in the cellulosic fibrous structure. This disruption occurs because these bonds are formed and set upon drying of the embryonic fibrous slurry. After drying, moving selected fibers normal to the plane of the cellulosic fibrous structure (e.g., via embossing) breaks the bonds which may result in a cellulosic fibrous structure with less tensile strength. If strength loss is anticipated, the base cellulosic fibrous structure can be adjusted to compensate for the strength loss, but this approach can yield less softness than the cellulosic fibrous structure had before embossing and structure compensation. Unfortunately, a trade-off is not necessarily appealing to the consumer because softness and tensile strength are important attributes to the consumer during use of the product.

It is also known that the use of a patterned belt during the papermaking process can impart aesthetically pleasing designs into the surface of the cellulosic fibrous structure without many of the complexities associated with embossing. However, the use of patterned belts may be used in combination with embossing because some patterned belts of the prior art have not been able to provide surface features with the same level of definition that embossing provides. Again, embossing provides the surface of the cellulosic fibrous structure with a highly desirable quilted appearance, and may also have a positive impact on the functional attributes of absorbency, compressibility, and bulk of the cellulosic fibrous structure. However, it known that embossing may cause stiffness at the pattern edges, and may cause the paper to have a gritty texture.

Accordingly, the present invention addresses the above considerations by providing a cellulosic fibrous structure with highly defined surface features that are not formed from embossing.

BRIEF DESCRIPTION OF THE DRAWINGS

While the specification concludes with claims that particularly point out and distinctly claim the present invention, it is believed that the present invention will be understood better from the following description of embodiments, taken in conjunction with the accompanying drawings, in which like reference numerals identify identical elements.

Without intending to limit the invention, embodiments are described in more detail below.

SUMMARY OF THE INVENTION

Figure 1A:
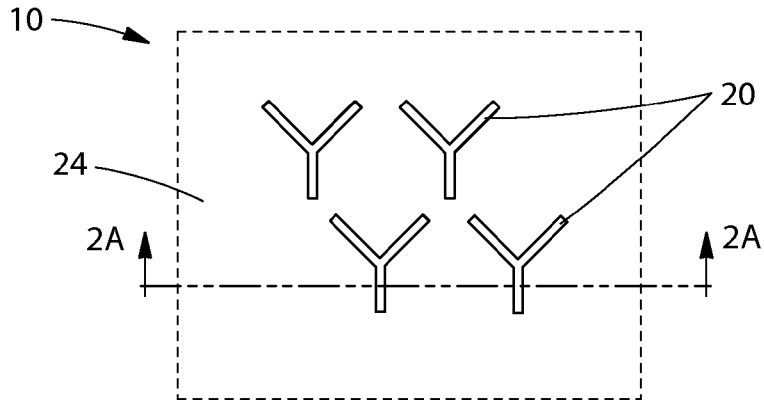
FIG. 1A is a fragmentary plan view of a cellulosic fibrous structure product displaying an embodiment of a pattern imparted to the cellulosic fibrous structure during the papermaking process.

In one embodiment, the present invention relates to a cellulosic fibrous structure product comprising: one or more plies wherein at least one of the plies comprises one or more unembossed areas; wherein at least one unembossed area comprises a macroscopic first surface and a macroscopic second surface; wherein the fibrous structure product further comprises a first wall which forms vertices with the first surface and the second surface; and wherein the first wall and the second surface form a top side wall angle of from about 90° to about 140°.

In another embodiment, the present invention relates to a cellulosic fibrous structure product comprising: one or more plies wherein at least one of the plies comprises one or more unembossed areas; wherein at least one of the unembossed areas further comprises a macroscopic first surface and a macroscopic second surface; wherein the unembossed area further comprises a first wall which forms vertices with the macroscopic first surface and the macroscopic second surface; and wherein the second surface comprises from about 10% to about 45% of the total surface area of each ply that is defined by a repeatable pattern.

In another embodiment, the present invention relates to a cellulosic fibrous structure product comprising: one or more plies wherein at least one of the plies comprises one or more unembossed areas; wherein at least one of the unembossed areas further comprises a macroscopic first surface, a macroscopic second surface, and a macroscopic third surface; wherein the unembossed area further comprises a first wall which forms vertices with the macroscopic first surface and the macroscopic second surface; a second wall which forms vertices with the macroscopic first surface and the macroscopic third surface; a third wall which forms vertices with the macroscopic second surface and the macroscopic third surface; wherein the second surface comprises from about 8% to about 30% of the total surface area of each ply that is defined by a repeatable pattern; and wherein the third surface comprises from about 10% to about 35% of the total surface area of each ply that is defined by a repeatable pattern.

DETAILED DESCRIPTION OF THE INVENTION

As used herein, "paper product" refers to any formed, fibrous structure products, traditionally, but not necessarily, comprising cellulose fibers. In one embodiment, the paper products of the present invention include tissue-towel paper products.

"Cellulosic fibrous structure product" refers to products comprising paper tissue or paper towel technology in general, including, but not limited to, conventional felt-pressed or conventional wet-pressed fibrous structure product, pattern densified fibrous structure product, starch substrates, and high bulk, uncompacted fibrous structure product. Non-limiting examples of tissue-towel paper products include disposable or reusable, toweling, facial tissue, bath tissue, table napkins, placemats, wipes, and the like.

"Ply" or "Plies", as used herein, means an individual fibrous structure or sheet of fibrous structure, optionally to be disposed in a substantially contiguous, face-to-face relationship with other plies, forming a multi-ply fibrous structure. It is also contemplated that a single fibrous structure can effectively form two "plies" or multiple "plies", for example, by being folded on itself. In one embodiment, the ply has an end use as a tissue-towel paper product. A ply may comprise one or more wet-laid layers, air-laid layers, and/or combinations thereof. If more than one layer is used, it is not necessary for each layer to be made from the same fibrous structure. Further, the layers may or may not be homogenous within a layer. The actual makeup of a fibrous structure product ply is generally determined by the desired benefits of the final tissue-towel paper product, as would be known to one of skill in the art. The fibrous structure may comprise one or more plies of non-woven materials in addition to the wet-laid and/or air-laid plies.

"Fibrous structure" as used herein means an arrangement of fibers produced in any papermaking machine known in the art to create a ply of paper. "Fiber" means an elongate particulate having an apparent length greatly exceeding its apparent width. More specifically, and as used herein, fiber refers to such fibers suitable for a papermaking process. The present invention contemplates the use of a variety of paper making fibers, such as, natural fibers, synthetic fibers, as well as any other suitable fibers, starches, and combinations thereof. Paper making fibers useful in the present invention include cellulosic fibers commonly known as wood pulp fibers. Applicable wood pulps include chemical pulps, such as Kraft, sulfite and sulfate pulps; mechanical pulps including groundwood, thermomechanical pulp; chemithermomechanical pulp; chemically modified pulps, and the like. Chemical pulps, however, may be preferred in tissue towel embodiments since they are known to those of skill in the art to impart a superior tactical sense of softness to tissue sheets made therefrom. Pulps derived from deciduous trees (hardwood) and/or coniferous trees (softwood) can be utilized herein. Such hardwood and softwood fibers can be blended or deposited in layers to provide a stratified web. Exemplary layering embodiments and processes of layering are disclosed in U.S. Pat. Nos. 3,994,771 and 4,300,981. Additionally, fibers derived from non-wood pulp such as cotton linters, bagesse, and the like, can be used. Additionally, fibers derived from recycled paper, which may contain any or all of the pulp categories listed above, as well as other non-fibrous materials such as fillers and adhesives used to manufacture the original paper product may be used in the present web. In addition, fibers and/or filaments made from polymers, specifically hydroxyl polymers, may be used in the present invention. Non-limiting examples of suitable hydroxyl polymers include polyvinyl alcohol, starch, starch derivatives, chitosan, chitosan derivatives, cellulose derivatives, gums, arabinans, galactans, and combinations thereof. Additionally, other synthetic fibers such as rayon, lyocel, polyester, polyethylene, and polypropylene fibers can be used within the scope of the present invention. Further, such fibers may be latex bonded. Other materials are also intended to be within the scope of the present invention as long as they do not interfere or counter act any advantage presented by the instant invention.

"Basis Weight", as used herein, is the weight per unit area of a sample reported in lbs/3000 $ft^2$ or $g/m^2$.

"Machine Direction" or "MD", as used herein, means the direction parallel to the flow of the fibrous structure through the papermaking machine and/or product manufacturing equipment.

"Cross Machine Direction" or "CD", as used herein, means the direction perpendicular to the machine direction in the same plane of the fibrous structure and/or fibrous structure product comprising the fibrous structure.

"Differential density", as used herein, means a portion of a fibrous structure product that is characterized by having a relatively high-bulk field of relatively low fiber density and an array of densified zones of relatively high fiber density. The high-bulk field is alternatively characterized as a field of pillow regions. The densified zones are alternatively referred to as knuckle regions. The densified zones may be discretely spaced within the high-bulk field or may be interconnected, either fully or partially, within the high-bulk field. One embodiment of a method of making a differential density fibrous structure and devices used therein are described in U.S. Pat. Nos. 4,529,480 and 4,528,239.

"Densified", as used herein means a portion of a fibrous structure product that is characterized by zones of relatively high fiber density. The densified zones are alternatively known as "knuckle regions" or "pseudo pillow regions". The densified zones may be discretely spaced within the high-bulk field or may be interconnected, either fully or partially, within the high bulk field.

"Non-densified", as used herein, means a portion of a fibrous structure product that exhibits a lesser density than another portion of the fibrous structure product. The densified zones are alternatively known as "pillow regions".

"Macrofolding" as used herein, is defined as causing a low-fiber-consistency web to fold in such a manner that adjacent MD spaced portions of the web become stacked on each other in the Z-direction of the web.

"Wet-microcontracting", as used herein, is wet-end machine-direction-foreshortening which is effected in such a manner that macrofolding is substantially precluded.

"Vertex," or "vertices", as used herein, means a point that terminates a line or curve or comprises the intersection of two or more lines or curves as is measured by the wall angle method.

"Repeatable pattern", as used herein, means the smallest sequence of visually distinct units that are identical to other sequences of visually distinct units within a larger design.

"Macroscopic," "macroscopical," or "macroscopically," as used herein, refer to an overall geometry of a structure under consideration when it is placed in a two-dimensional configuration. In contrast, "microscopic," "microscopical," or "microscopically" refer to relatively small details of the structure under consideration, without regard to its overall geometry. For example, in the context of the fibrous structure products 10 the term "macroscopically planar" means that the fibrous structure products 10 when viewed from a cross-section, has only minor and tolerable deviations from the absolute planarity of the discrete surfaces. Specifically, deviations caused by the fibers 110 that form the belt 100 do not affect the planarity of the fibrous structure product. Further, deviations that are smaller than 3.9375 mils (about 0.1 mm) in height are not considered macroscopic.

"Transition region", as used herein, means the region of the cross-sectional profile of the cellulosic fibrous structure connecting one surface to another surface. In some embodiments, a transition region may be described by a wall or wall region. The method of identifying a transition region is defined in the "wall angle measurement method" below.

In one embodiment, the cellulosic fibrous structure product substrate may be manufactured via a wet-laid paper making process. In other embodiments, the cellulosic fibrous structure product substrate may be manufactured via a through-air-dried paper making process or foreshortened by creping or by wet microcontraction. In some embodiments, the resultant cellulosic fibrous structure plies may be differential density fibrous structure plies, wet laid fibrous structure plies, air laid fibrous structure plies, conventional fibrous structure plies, and combinations thereof. Creping and/or wet microcontraction are disclosed in U.S. Pat. Nos. 6,048,938, 5,942,085, 5,865,950, 4,440,597, 4,191,756, and 6,187,138.

Making Products With Formed Surface Features

In one embodiment, the present invention product may be made using a papermaking machine, such as one exemplified in U.S. Pat. Nos. 4,528,239 or 7,229,528. The process for making the present invention product may comprise steps that are not performed in prior art papermaking processes. In one embodiment, the steps of forming an embryonic web from an aqueous fibrous papermaking furnish, forwarding the web at a first velocity on a carrier fabric or belt to a transfer zone having a transfer/imprinting fabric, non-compressively removing water from the web to a fiber consistency of from about 10% to about 30%, immediately prior to reaching the transfer zone to enable the web to be transferred to the transfer/imprinting fabric at the transfer zone; transferring the web to the transfer/imprinting fabric in the transfer zone without precipitating substantial densification of the web; forwarding, at a second velocity, the transfer/imprinting fabric along a looped path in contacting relation with a transfer head disposed at the transfer zone, the second velocity being from about 5% to about 40% slower than the first velocity; adhesively securing the web to a drying cylinder having a third velocity; drying the web without overall mechanical compaction of the web; creping the web from the drying cylinder with a doctor blade, the doctor blade having an impact angle of from about 90 degrees to about 130 degrees; and reeling the web at a fourth velocity that is faster than the third velocity of the drying cylinder.

Without wishing to be limited by theory, it is thought that by having the described the impact angle, the resultant paper has improved texture and softness qualities. Also without wishing to be limited by theory, it is thought that by running the papermaking belt, drying cylinder, and reeling the paper at the relative velocities described supra, provides a final product having more well defined features than features that are formed in the wet-end by prior art processes.

Briefly, the cellulosic fibrous structure products of one embodiment of the present invention can be formed from aqueous slurry of papermaking fibers. A cellulosic fibrous web is formed at a low fiber consistency on a foraminous member to a differential velocity transfer zone where the web is transferred to a slower moving member such as a loop of open weave fabric to achieve wet-microcontraction of the web in the machine direction without precipitating substantial macrofolding or compaction of the web; and, subsequent to the differential velocity transfer, drying the web without overall compaction and without further material rearrangement of the fibers of the web in the plane thereof. The paper may be pattern densified by imprinting a fabric knuckle pattern into it prior to final drying; and the paper may be creped after being dried. Also, primarily for product caliper control, the paper may be lightly calendared after being dried. A primary facet of the process is to achieve the differential velocity transfer without precipitating substantial compaction (i.e., densification) of the web. Thus, the web is said to be wet-microcontracted as opposed to being wet-compacted or macro-folded or the like. The resulting substrate has one or more plies of fibrous structure wherein at least one of the plies comprises two or more planes formed during the papermaking process wherein each plane is discontinuous from the other planes and wherein at least one of the planes comprises a continuous region. In an embodiment, the cellulosic fibrous structure product of the present invention has a pattern on the surface of the cellulosic fibrous structure product comprising densified areas and pillow regions. The densified areas of the cellulosic fibrous structure product are characterized by a relatively high fiber density. The pillow regions of the fibrous structure product are characterized as a high-bulk field of relatively low fiber density.

In another embodiment, there is a third density region, the pseudo-pillow region, which comprises a fiber density that is greater than or equal to that of a pillow region, but less than that of a densified area. The densified zones may be discretely spaced within the high-bulk field or may be interconnected, either fully or partially, within the high-bulk field. Processes for making pattern densified fibrous structures include, but are not limited to those processes disclosed in U.S. Pat. Nos. 3,301,746, 3,974,025, 4,191,609, 4,637,859, 3,301,746, 3,821,068, 3,974,025, 3,573,164, 3,473,576, 4,239,065, and 4,528,239. In one embodiment, the present invention relates to a multi-ply fibrous structure product comprising one or more plies of fibrous structure wherein at least one of the plies comprises at least three planar surfaces formed during the papermaking process wherein each surface is discontinuous from the other planes, wherein at least one of the surfaces comprises one or more densified regions, another surface comprises one or more pillow regions, and at least one other surface comprises pseudo-pillow regions. In some embodiments of the present invention product, there may be from about 10 domes per $in^2$ to about 1000 domes per $in^2$ of the product. In another embodiment, the product comprises from about 90 domes per $in^2$ to about 500 domes per $in^2$. In yet another embodiment the product comprises from about 120 domes per $in^2$ to about 180 domes per $in^2$.

Surprisingly, it was found that paper products having surface features which are too deep on one side may exhibit negative characteristics in the cellulosic fibrous structure product. For example, in a multi-ply cellulosic fibrous structure product, surface features which are too deep may actually cause the surface features of one ply to actually penetrate to the surface of the adjacent ply. Even more surprisingly, it was found that an optimal range for non-embossed features on a cellulosic fibrous structure have a transition region height of greater than about 0.35 mm and a ratio of the slope of the transition region to the height of the transition region is from about 2.0 to about 4.0.

FIG. 1A is a fragmentary plan view of an embodiment of one ply of a cellulosic fibrous structure product 10 comprising formed surface features 52 with a macroscopic second surface, under which comprises densified knuckle regions 20, formed in the cellulosic fibrous structure during the papermaking process. The densified knuckle regions 20 are adjacent to a macroscopic first surface under which comprises pillow regions 24.

Figure 1B:
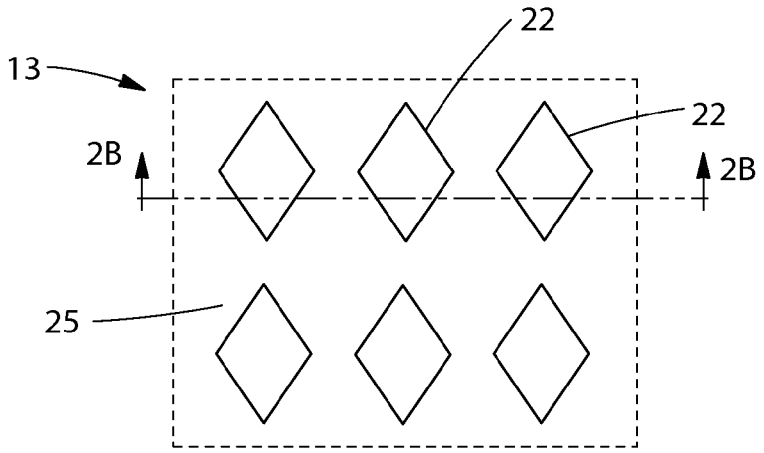
FIG. 1B is a fragmentary plan view of a cellulosic fibrous structure product displaying an embodiment of a pattern imparted to the cellulosic fibrous structure during the papermaking process.

FIG. 1B is a fragmentary plan view of an embodiment of one ply of a cellulosic fibrous structure product 10 comprising formed surface features 52 with a macroscopic second surface, under which comprises densified knuckle regions 20, formed in the cellulosic fibrous structure during the papermaking process. The densified knuckle regions 20 are adjacent to a macroscopic first surface under which comprises pillow regions 24.

Figure 1C:
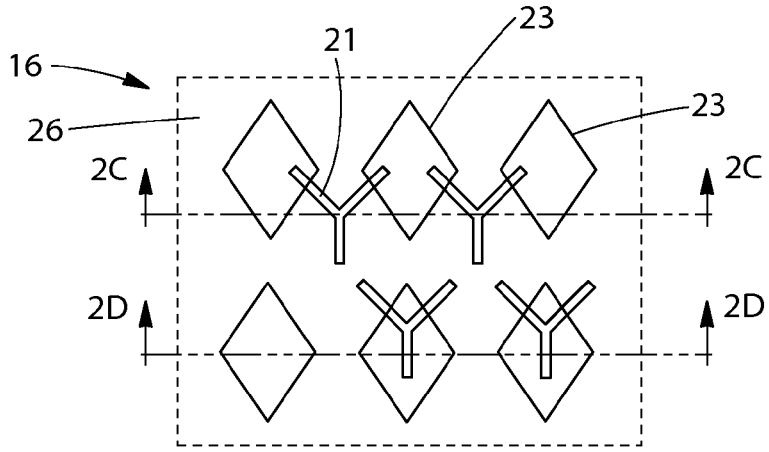
FIG. 1C is a fragmentary plan view of a cellulosic fibrous structure product displaying an embodiment of a pattern imparted to the cellulosic fibrous structure during the papermaking process.

FIG. 1C is a fragmentary plan view of an embodiment of one ply of a cellulosic fibrous structure product 10 comprising formed surface features 52 with a macroscopic second surface, under which comprises discrete pseudo-pillow regions 23, and a macroscopic third surface, under which comprises densified knuckle regions 20, imparted to the cellulosic fibrous structure during the papermaking process. The pillow region 24 is adjacent to the macroscopic second surface under which comprises pseudo-pillow regions 23.

Figure 1D:
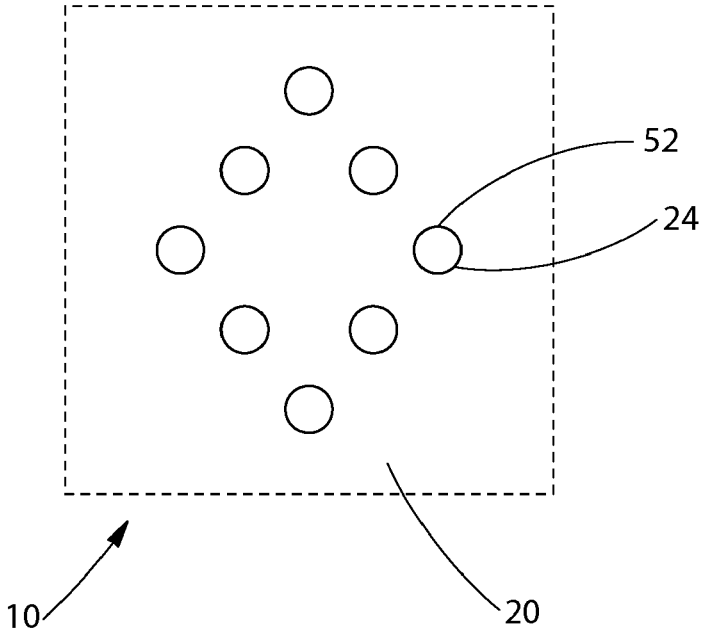
FIG. 1D is a fragmentary plan view of a cellulosic fibrous structure product displaying an embodiment of a pattern imparted to the cellulosic fibrous structure during the papermaking process.

FIG. 1D is a fragmentary plan view of an embodiment of one ply of a cellulosic fibrous structure product 10 comprising discrete surface features 52 which are surrounded by a continuous densified knuckle region 20, formed in the cellulosic fibrous structure during the papermaking process. The densified knuckle region 20 is continuous and comprises a macroscopic second surface that surrounds a macroscopic first surface under which comprises discrete pillow regions 24.

Figure 2A:
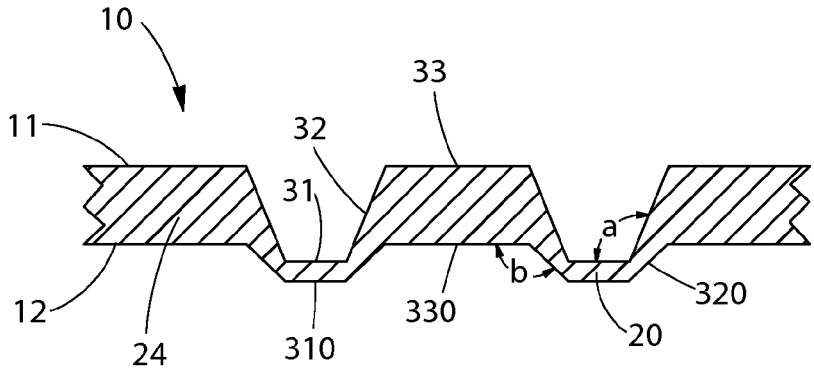
FIG. 2A is a cross-sectional view of an embodiment of a portion of the paper web shown in FIG. 1A as taken along line 2A-2A.

FIG. 2A is a cross-sectional view of an embodiment of a portion of the cellulosic fibrous structure product 10 shown in FIG. 1A as taken along line 2A-2A. Each ply has a top-side 11 and a bottom-side 12. On the top side 11 the plane of the first surface 33, under which comprises pillow regions 24, is discrete from the plane of the macroscopic second surface 31 under which comprises densified regions 20. A first wall 32 forms vertices with the macroscopic first surface 33 and the macroscopic second surface 31. A top side wall angle $\alpha$ characterizes the angle formed by the first wall 32 and the macroscopic second surface 31. On the bottom side 12 the plane of the bottom side macroscopic first surface 330, above which comprises pillow regions 24, is discrete from the plane of the bottom side macroscopic second surface 310 above which comprises densified regions 20. A bottom side first wall 320 forms vertices with the bottom side macroscopic first surface 330 and the bottom side macroscopic second surface 310. A bottom side wall angle $\beta$ characterizes the angle formed by the bottom side first wall 320 and the bottom side macroscopic second surface 330. In one embodiment, the top side wall angle, $\alpha$, as measured by the wall angle measurement method described below, is from about 90° to about 140°. In another embodiment, the top side wall angle is from about 110° to about 130°. In another embodiment still, the top side wall angle is from about 115° to about 125°. In one embodiment, the bottom side wall angle, $\beta$, as measured by the wall angle measurement method described below, is from about 90° to about 140°. In another embodiment, the bottom side wall angle is from about 110° to about 130°. In another embodiment still, the bottom side wall angle is from about 115° to about 125°.

Figure 2B:
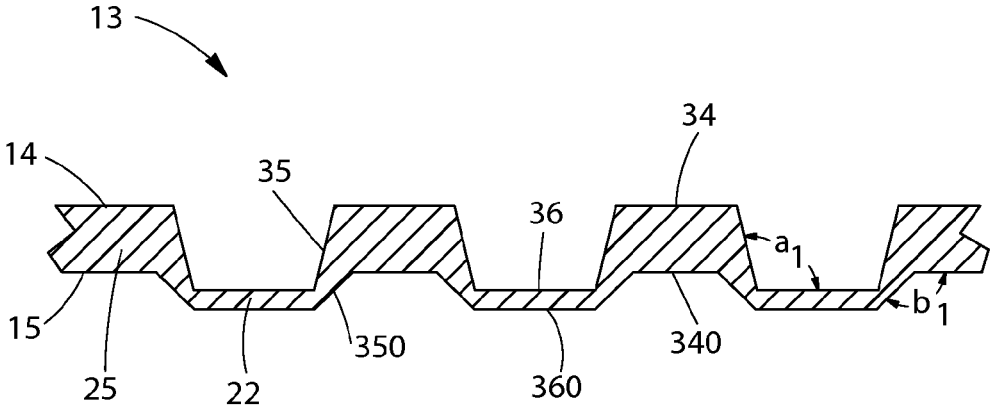
FIG. 2B is a cross-sectional view of an embodiment of a portion of the paper web shown in FIG. 1B as taken along line 2B-2B.

FIG. 2B is a cross-sectional view of an embodiment of a portion of the cellulosic fibrous structure product 10 shown in FIG. 1B as taken along line 2B-2B. Each ply has a top-side 11 and a bottom-side 12. On the top side 11, the plane of the macroscopic first surface 33, under which comprise pillow regions 24, is discrete from the plane of the macroscopic second surface 31 under which comprises densified regions 20. A first wall 32 forms vertices with the macroscopic first surface 33 and macroscopic second surface 31. A top side wall angle α characterizes the angle formed by the first wall 33 and the macroscopic second surface 31. On the bottom side 12, the plane of the bottom side macroscopic first surface 330, above which comprises pillow regions 24, is discrete from the plane of the bottom side macroscopic second surface 310 above which comprises densified regions 20. A bottom side first wall 320 forms vertices with the bottom side macroscopic first surface 330 and the bottom side macroscopic second surface 310. A bottom side wall angle β characterizes the angle formed by the bottom side first wall 320 and the bottom side macroscopic first surface 330. In one embodiment, the top side wall angle, α, as measured by the wall angle measurement method described below, is from about 90° to about 140°. In another embodiment, the top side wall angle is from about 110° to about 130°. In another embodiment still, the top side wall angle is from about 115° to about 125°. In one embodiment, the bottom side wall angle, β, as measured by the wall angle measurement method described below, is from about 90° to about 140°. In another embodiment, the bottom side wall angle is from about 110° to about 130°. In another embodiment still, the bottom side wall angle is from about 115° to about 125°.

In an embodiment of the present invention, the cellulosic fibrous structure has a transition region height of greater than about 0.35 mm and the ratio of the slope of the transition region to the height of the transition region is from about 2.0 to about 4.0.

In certain embodiments, the macroscopic first surface may be either: continuous, semi continuous, discontinuous, or combinations thereof. In other embodiments, the macroscopic second surface may be either: continuous, semicontinuous, discontinuous, or combinations thereof.

Figure 2C:
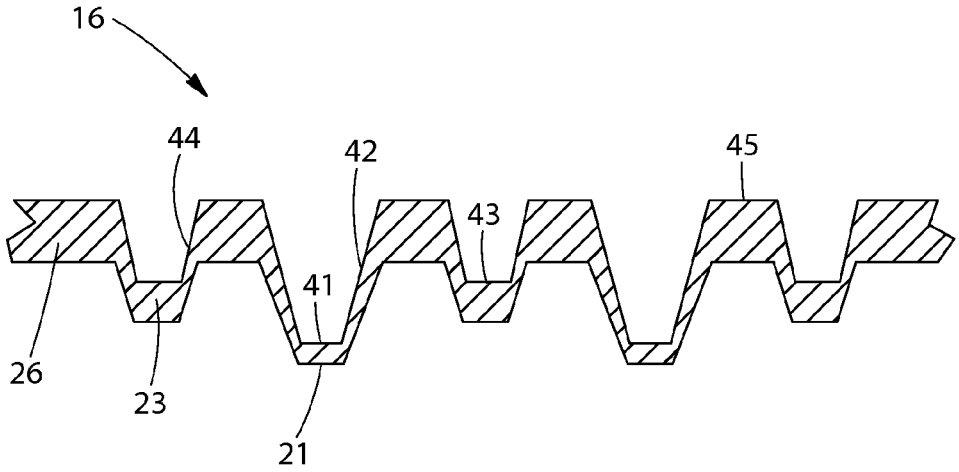
FIG. 2C is a cross-sectional view of an embodiment of a portion of the paper web shown in FIG. 1C as taken along line 2C-2C.

FIG. 2C is a cross-sectional view of an embodiment of a portion of the cellulosic fibrous structure product 10 shown in FIG. 1C as taken along line 2C-2C. The area below the macroscopic third surface 41 comprises a densified region 20. The area below the macroscopic second surface 31 comprises a pseudo-pillow region 23. The area below the macroscopic first surface 33 comprises a pillow region 24. The macroscopic first surface 33 is discrete from the macroscopic second surface 31 which is discrete from the macroscopic third surface 41. The first wall 32 forms vertices with the macroscopic first surface 33 and the macroscopic second surface 31. The second wall 42 forms vertices with the macroscopic first surface 33 and the macroscopic third surface 41.

Figure 2D:
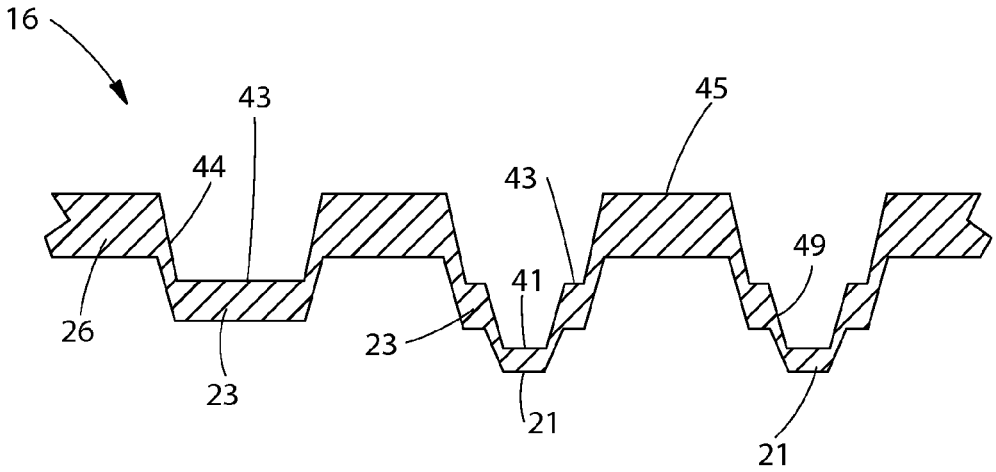
FIG. 2D is a cross-sectional view of an embodiment of a portion of the paper web shown in FIG. 1C as taken along line 2D-2D.

FIG. 2D is a cross-sectional view of an embodiment of a portion of the cellulosic fibrous structure product 10 shown in FIG. 1C as taken along line 2D-2D. The area below the macroscopic third surface 41 comprises a densified region 20. The area below the second surface 31 comprises pseudo-pillow region 23. The area below the macroscopic first surface 33 comprises a pillow region 24. The macroscopic first surface 33 is discrete from the macroscopic second surface 31 which is discrete from the macroscopic third surface 41. The first wall 32 forms vertices with the macroscopic first surface 33 and the macroscopic second surface 31. The third wall 49 forms vertices with the macroscopic second surface 31 and the macroscopic third surface 41.

Figure 3A:
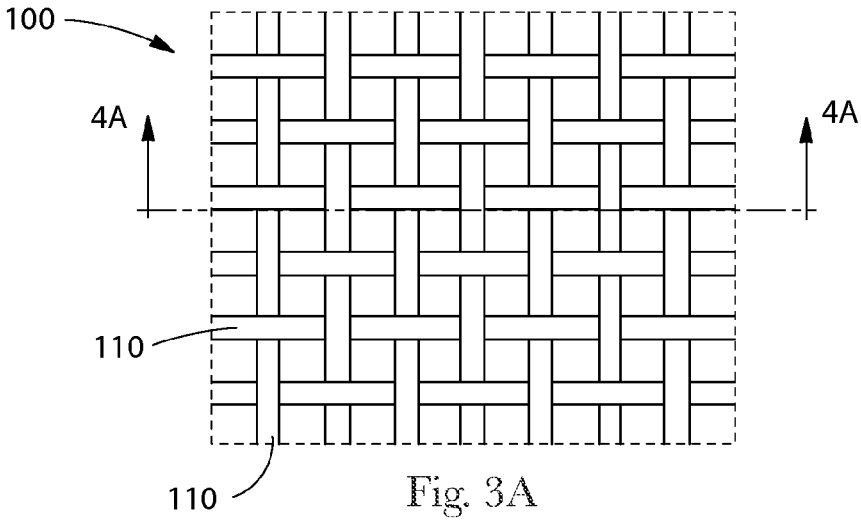
FIG. 3A is a fragmentary plan view of an embodiment of a papermaking belt.

FIG. 3A is a fragmentary plan view of an embodiment of a belt 100 of a papermaking process. Fibers 110 are woven together to form the belt 100.

Figure 3B:
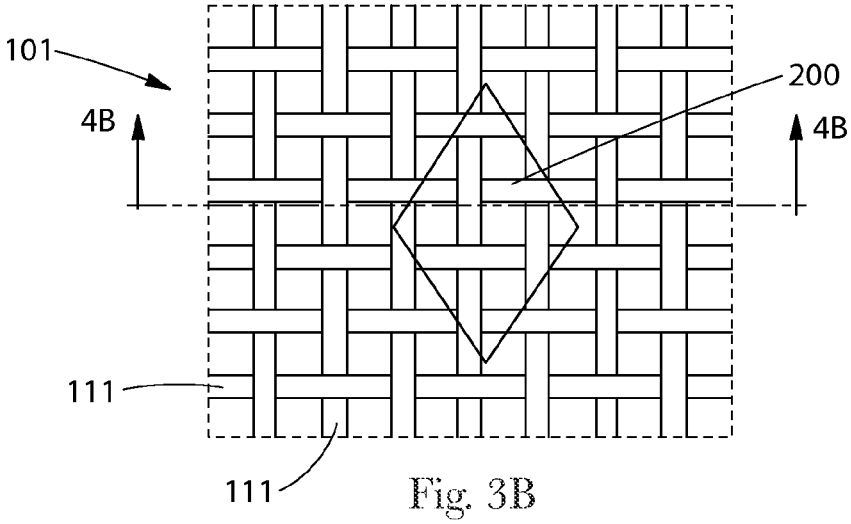
FIG. 3B is a fragmentary plan view of an embodiment of a papermaking belt.

FIG. 3B is a fragmentary plan view of an embodiment of a belt 100 on which a first polymeric resin 200 has been disposed. Fibers 110 are woven together the form the belt 100.

Figure 3C:
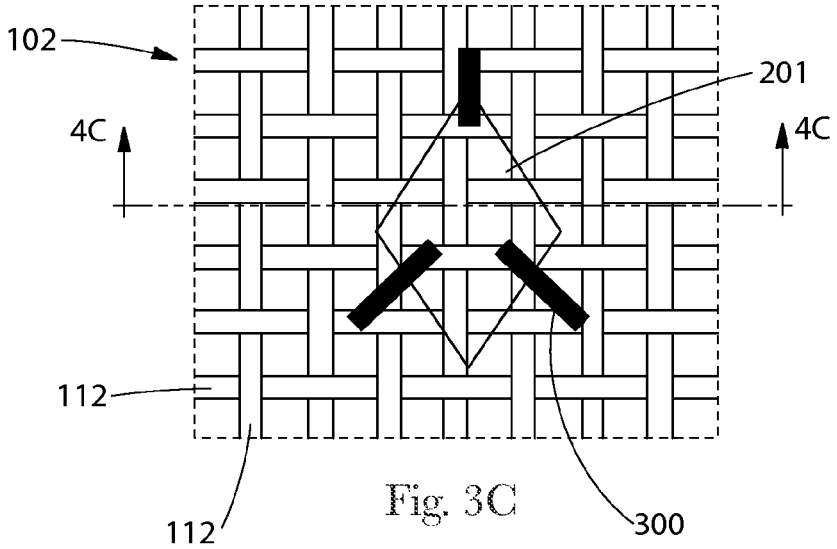
FIG. 3C is a fragmentary plan view of an embodiment of a papermaking belt.

FIG. 3C is a fragmentary plan view of an embodiment of a belt 100 on which a first polymeric resin 200 has been disposed. A second polymeric resin 300 is disposed over the first polymeric network 200. Fibers 110 are woven together the form the belt 100.

Figure 4A:
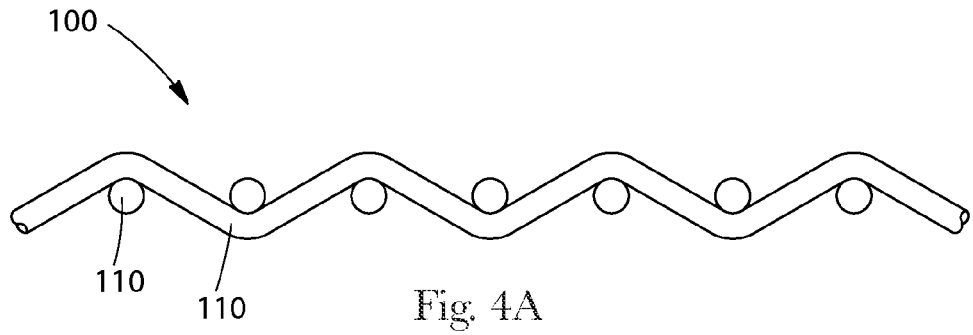
FIG. 4A is a cross-sectional view of an embodiment of a portion of the belt shown in FIG. 3A as taken along line 4A-4A.

FIG. 4A is a cross-sectional view of an embodiment of a portion of the belt 100 shown in FIG. 3A as taken along line 4A-4A. Fibers 110 are woven together the form the belt 100.

Figure 4B:
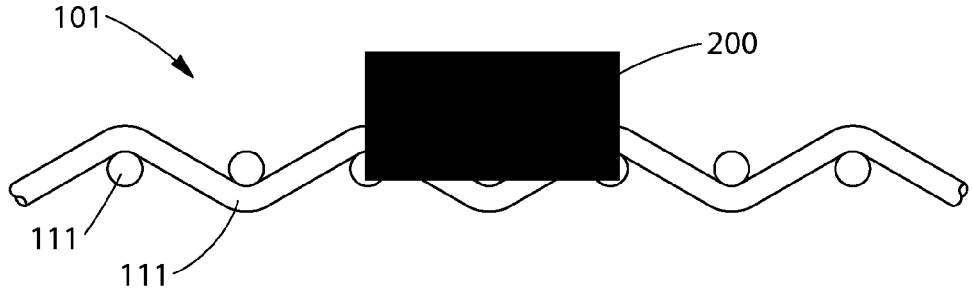
FIG. 4B is a cross-sectional view of an embodiment of a portion of the belt shown in FIG. 3B as taken along line 4B-4B.

FIG. 4B is a cross-sectional view of an embodiment of a portion of the belt 100 shown in FIG. 3B as taken along line 4B-4B. A first polymeric resin 200 has been disposed onto the surface of the belt 100. Fibers 110 are woven together the form the belt 100.

Figure 4C:
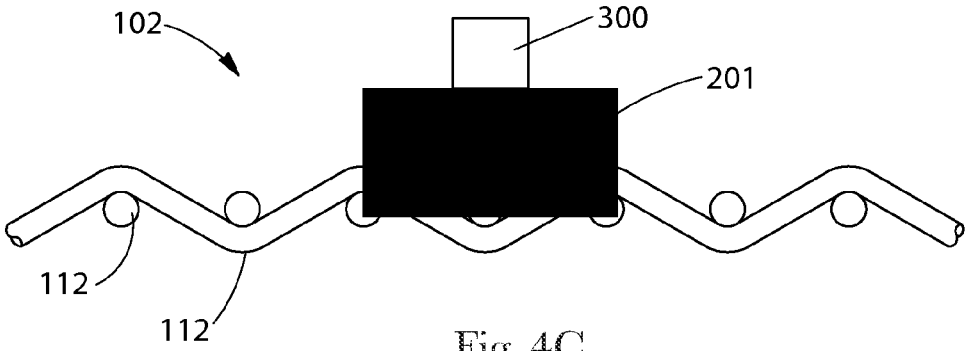
FIG. 4C is a cross-sectional view of an embodiment of a portion of the belt shown in FIG. 3C as taken along line 4C-4C.

FIG. 4C is a cross-sectional view of an embodiment of a portion of the belt 100 shown in FIG. 3C as taken along line 4C-4C. A first polymeric resin 200 has been disposed onto the surface of the belt 100. A second, discrete polymeric resin 300 is disposed over the first polymeric network 200. Fibers 110 are woven together the form the belt 100.

Figure 5A:
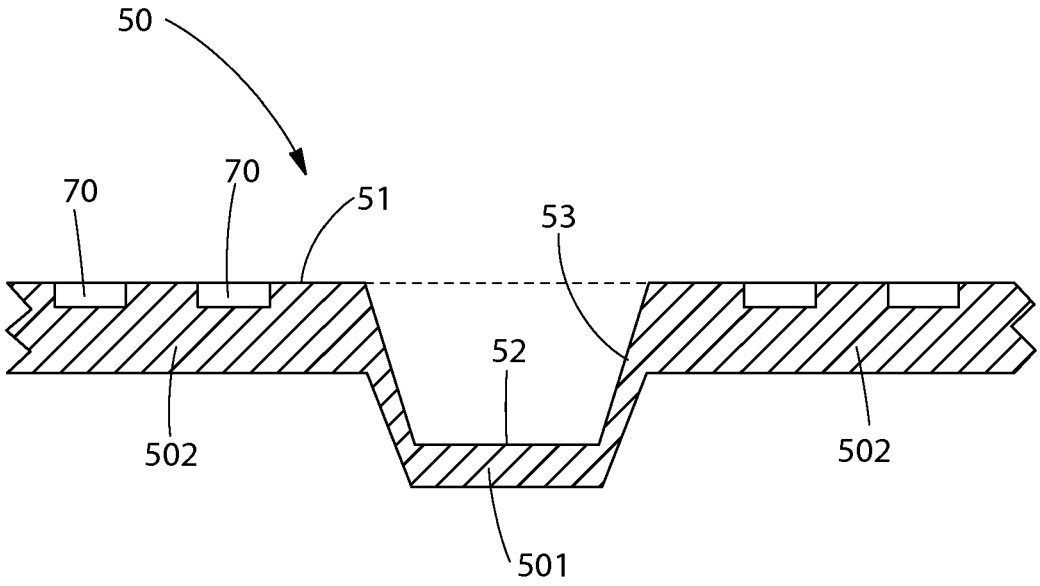
FIG. 5A is a cross-sectional view of an embodiment of a portion of the cellulosic fibrous structure product as formed by the belt shown in FIG. 3B.

FIG. 5A is a cross-sectional view of an embodiment of a portion of a cellulosic fibrous structure product 10 formed by the belt shown in FIG. 3B. The densified region 20 is adjacent to pillow regions 24. The macroscopic first surface 33 is discrete from the macroscopic second surface 31. The first wall 32 forms vertices with the macroscopic first surface 33 and the macroscopic second surface 31. The fibers 110 that form the belt 100 leave microscopic impressions 70 on the first surface 31 in the pillow regions 24. However, the microscopic impressions 70 do not affect the macroscopic planarity of the macroscopic first surface 31.

Figure 5B:
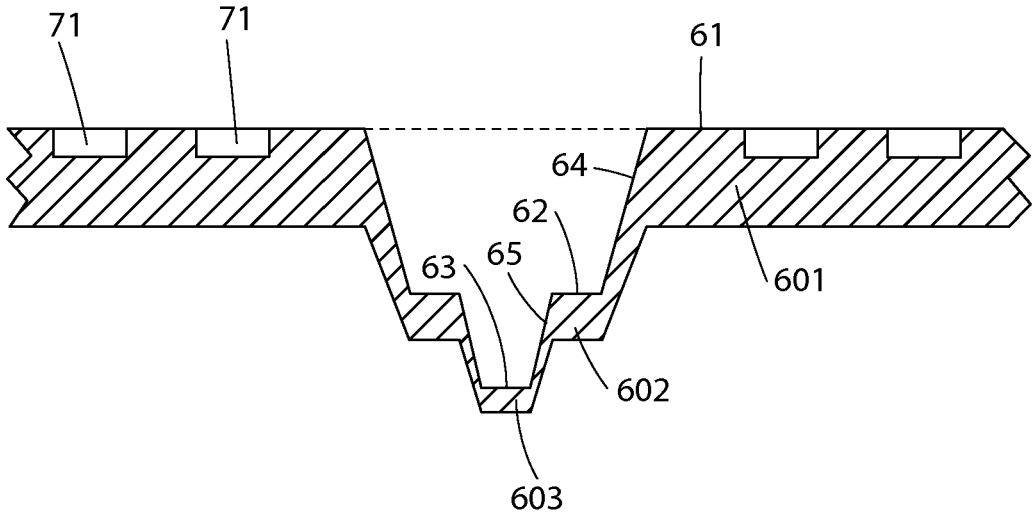
FIG. 5B is a cross-sectional view of an embodiment of a portion of the cellulosic fibrous structure product as formed by the belt shown in FIG. 3C.

FIG. 5B is a cross-sectional view of an embodiment of a portion of a cellulosic fibrous structure product 10 formed by the belt shown in FIG. 3C. The densified region 20 is adjacent to pseudo pillow regions 23 which are adjacent to pillow regions 24. The macroscopic first surface 33 is discrete from the macroscopic second surface 31 which is discrete from the macroscopic third surface 41. The first wall 32 forms vertices with the macroscopic first surface 33 and the macroscopic second surface 31. The second wall 49 forms vertices with the macroscopic second surface 31 and the macroscopic third surface 41. The fibers 110 that form the belt 100 leave microscopic impressions 70 on the macroscopic first surface 31 in the pillow regions 601. However, the microscopic impressions 71 do not affect the macroscopic planarity of the macroscopic first surface 33.

Figure 6:
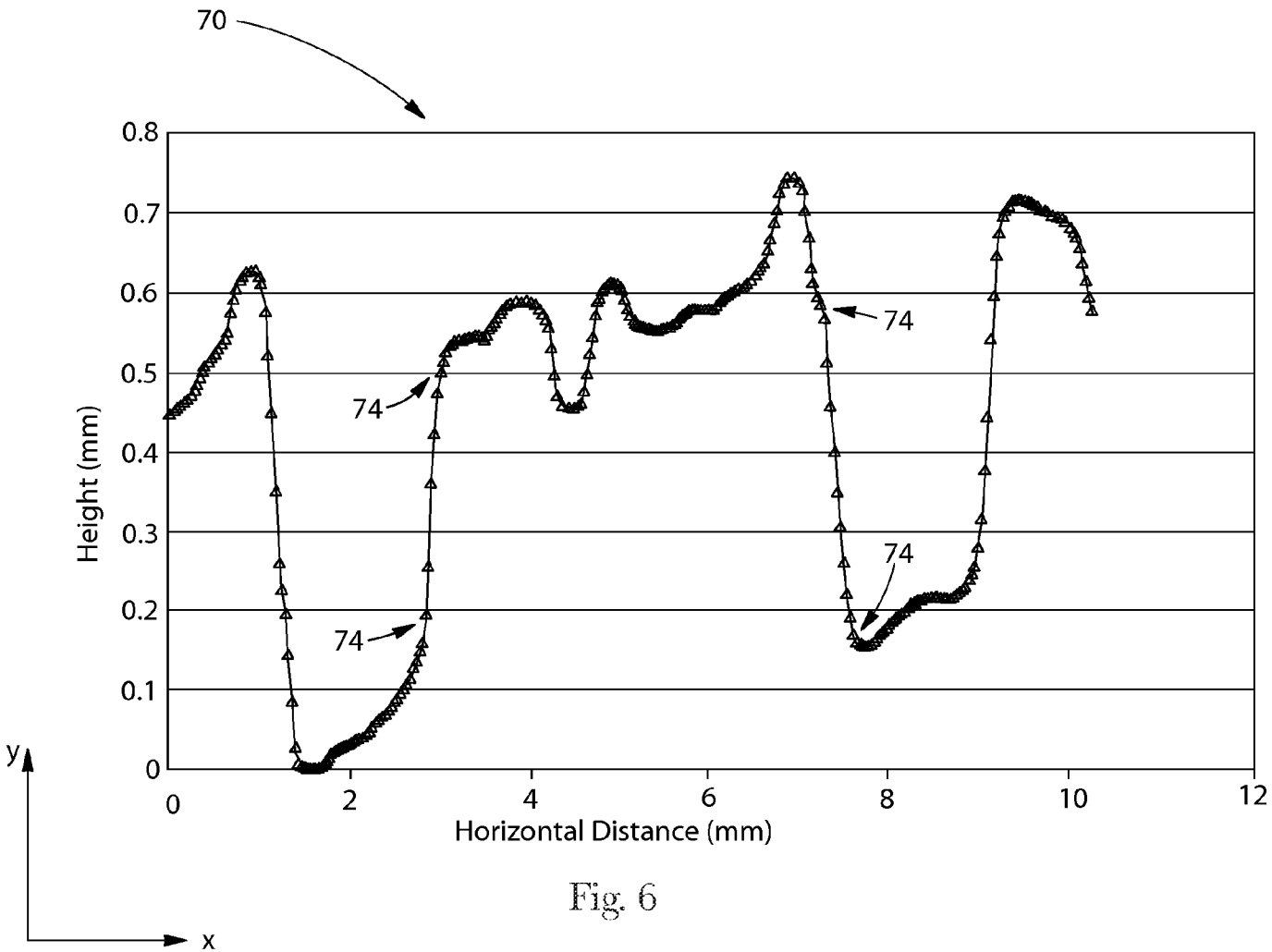
FIG. 6 is a graphical representation of a profilometric measurement of the surface of one embodiment of the cellulosic fibrous structure product.

FIG. 6 is a graphical representation of a profilometric measurement 700 of one embodiment of the surface of a cellulosic fibrous structure product of the present invention. The y-axis denotes the height of the surface features of the cellulosic fibrous structure product in millimeters and the x-axis denotes the horizontal distance across the cellulosic fibrous structure product in millimeters. The x, y coordinates of the beginning and the end of each transition zone 74 mark where calculations for the width and the height (and subsequently the slope and the angle) of the transition zone are measured.

Figure 7:
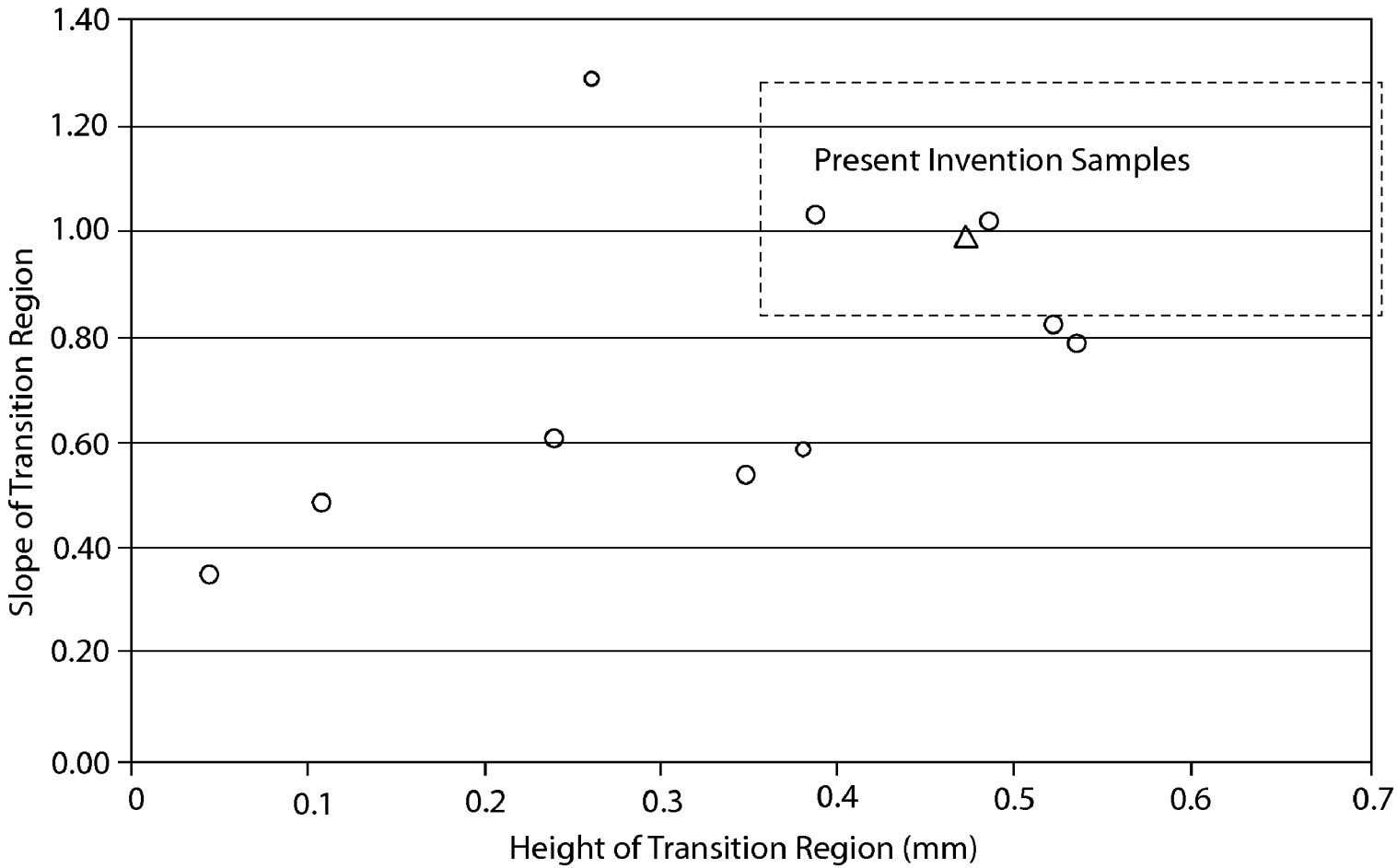
FIG. 7 is a graphical representation of the slope of the transition regions and the corresponding wall heights of some embodiments of the cellulosic fibrous structure product in addition to prior art samples.

FIG. 7 is a graphical representation of the slope of the transition regions and the corresponding wall heights of some embodiments of the cellulosic fibrous structure product in addition to prior art samples as measured by the Wall Angle Measurement Method described below. The data points plotted in FIG. 7 are tabulated in Table 1 below:

TABLE 1

Wall Angle Measurements

| Product | Height of Transition Region (mm) | Slope of Transition Region | Slope: TR Height | Backside Angle (degrees) | Wall Angle (degrees) |
|---|---|---|---|---|---|
| Present Invention #1 (single surface) | 0.386 | 104 | 2.694300518 | 46.12330271 | 133.8767 |
| Present Invention #2 (single surface) | 0.485 | 1.03 | 2.12371134 | 45.84667402 | 134.15333 |
| Present Invention #3 (single surface) | 0.471 | 1.00 | 2.123142251 | 45 | 135 |
| Prior Art (Bounty Basic ™ top side (The Procter & Gamble Co.)) | 0.522 | 0.82 | 1.570881226 | 39.35175263 | 140.64825 |
| Prior Art (Bounty Basic ™ bottom side (The Procter & Gamble Co.)) | 0.532 | 0.78 | 1.466165414 | 37.95423088 | 142.04577 |
| Prior Art (Scott ™ (Kimberly Clark) | 0.577 | 0.63 | 1.091854419 | 32.21092772 | 147.78907 |
| Prior Art (Bounty ™ (The Procter & Gamble Co.)) | 0.237 | 0.61 | 2.573839662 | 31.38319106 | 148.61681 |
| Prior Art (Brawny ™ (Georgia Pacific)) | 0.107 | 0.49 | 4.579439252 | 26.10485401 | 153.89515 |
| Prior Art ™ (Potlach Co.)) | 0.045 | 0.35 | 7.777777778 | 19.29004622 | 160.70995 |
| Product Described in U.S. Pat. No. 6,849,157 (top side | 0.26 | 1.3 | 5 | 52.43140797 | 127.56859 |
| Product Described in U.S. Pat. No. 6,849,157 (top side) | 0.38 | 0.59 | 1.552631579 | 30.54060485 | 149.4594 |

In certain embodiments, the density of the densified region formed below the third surface is greater than or equal to the density of the pillow region formed below the first surface, and the density of the densified region formed below the third surface is greater than or equal to the density of the pseudo pillow region formed below the second surface. The density of the pseudo pillow region formed below the second surface is greater than or equal to the density of the pillow region formed below the first surface. In other embodiments, the third surface comprises from about 10% to about 35% of the total surface area of each ply that is defined by a repeatable pattern; and the second surface comprises from about 8% to about 30% of the total surface area of each ply that is defined by a repeatable pattern.

In certain embodiments of the present invention, there are two or more sets of surface features. The surface features of the fibrous structure may be any size on the sheet and in relation to each other. In one embodiment, the surface features in one set are all identical. In another embodiment, at least one surface feature in one set of surface features is different from at least one other surface feature in that set of surface features.

In a particular embodiment of the present invention, the surface features are arranged as a mathematical transformation of a regular lattice pattern such that the transformed pattern does not appear to be in a regular lattice pattern. For example, taking an array of dots arranged in a regularly spaced arrangement on a grid wherein the coordinates are defined by orthogonal x and y axes, and changing the axes such that the angle formed between the axes is 30 degrees. An infinite number of mathematical manipulations can be made on the points to arrive at different arrangements of the lattice patterns.

Embossing

As described supra, embossing may provide advantages and disadvantages to a cellulosic fibrous structure product. In some embodiments, a cellulosic fibrous structure product having formed surface features may also be embossed. Embossing may be performed by any method/apparatus known in the art. An exemplary process for embossing a paper web in accordance with the present invention incorporates the use of a knob-to-rubber impression embossment technology. By way of a non-limiting example, a tissue ply structure is embossed in a nip between an embossing roll and a backside impression roll. The embossing roll may be made from any material known for making such rolls, including, without limitation, steel, ebonite, hard rubber and elastomeric materials, and combinations thereof. The backside impression roll may be made from any material for making such rolls, including, without limitation soft rubber. As known to those of skill in the art, the embossing roll may be provided with a combination of emboss protrusions and gaps. Each emboss protrusion comprises a base, a face, and one or more sidewalls. An exemplary process for achieving deep embossments is exemplified in U.S. Pat. Pub. No. 2007/0062658A1. Other methods/apparatus for embossing are described in U.S. Pat. Nos. 3,414,459, 4,320,162 and 5,468,323.

Figure 8:
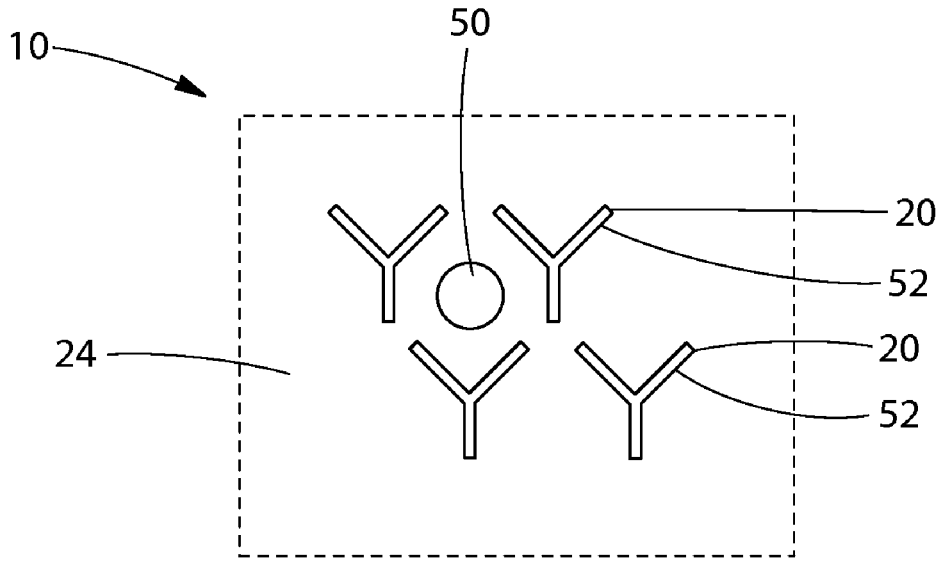
FIG. 8 is a fragmentary plan view of a cellulosic fibrous structure product displaying an embodiment of a pattern imparted to the cellulosic fibrous structure during the papermaking process wherein the cellulosic fibrous structure product is embossed.

FIG. 8 is a fragmentary plan view of an embodiment of one ply of a cellulosic fibrous structure product 10 comprising formed surface features 52 with a macroscopic second surface, under which comprises densified knuckle regions 20, imparted to the cellulosic fibrous structure during the papermaking process. The densified knuckle regions 20 are adjacent to a macroscopic first surface under which comprises pillow regions 24. The cellulosic fibrous structure further comprises an embossment 50.

Embossing Versus Formed Surface Patterns

Those of skill in the art may appreciate that embossing is performed in the dry end of the papermaking process, after the cellulosic fibrous structure web has already been formed. Surprisingly, it was discovered that by taking Micro CT images (described infra), clear physical distinctions between embossed features and formed features could be visually discerned. Without wishing to be limited by theory, it is thought that when a cellulosic fibrous structure web is embossed, localized areas of the cellulosic fibrous structure web is stretched and/or deformed out of the plane of the web. This can be compared to forming, wet molding, or any other wet-end sculpting processes because fibers are actually formed out of the plane of the web. It is thought that because of the localized stretching that occurs in the embossing process, the principle of conservation of mass dictates that the basis weight around the outer edge of an embossment is lower than the basis weight of a feature that is formed in the wet-end.

It is possible to visually observe differences in basis weight around surface features of a cellulosic fibrous structure product using techniques including, but not limited to, Micro CT imaging. In Micro CT imaging, a sample is x-rayed such that the relative basis weight of a sample in the Z-direction may be visually observed. In the Micro CT images provided herein, the lighter (more white) areas indicate a relatively higher amount of the variable of interest (basis weight, elevation) basis weight compared to darker (more black) areas. For example, in the elevation imaged FIG. 9A the top (MD-CD plane) surface of a formed feature will appear to be lighter than the top (MD-CD plane) surface of the unformed areas surrounding the formed feature, indicating more z-direction depth in the region of the formed feature. Similarly, the top (MD-CD plane) surface of an embossed feature will appear to be lighter than the top (MD-CD plane) of the unembossed areas surrounding the embossed feature. In this way, formed and embossed features can be identified in the Micro CT images. Micro CT is described in greater detail in the "Micro CT" section infra.

Figure 9A:
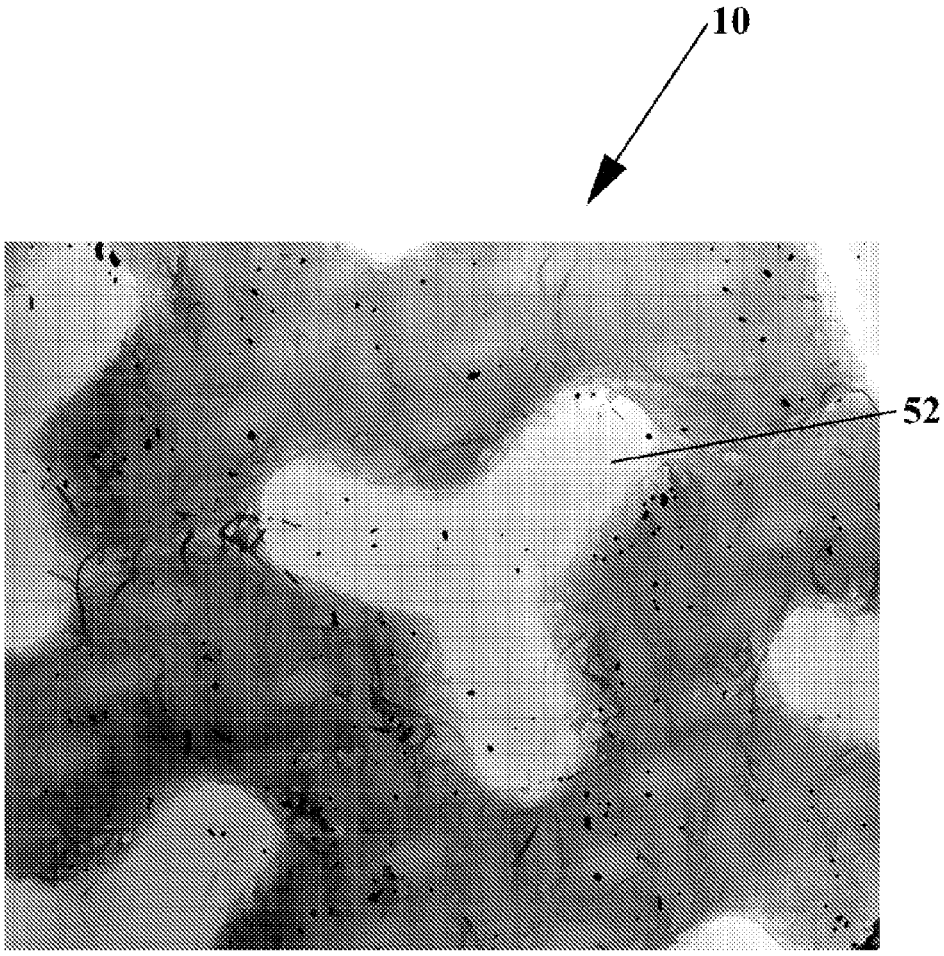
FIG. 9A is a Micro CT elevation, or top layer, image of a portion of the top layer of one embodiment of the cellulosic fibrous structure product of the present invention.

FIG. 9A shows a Micro CT elevation, or top layer, image at 2048×2048 pixels and 10 micron resolution of the top layer of an exemplary cellulosic fibrous structure 10 having formed surface features 52 of the present invention.

Figure 10A:
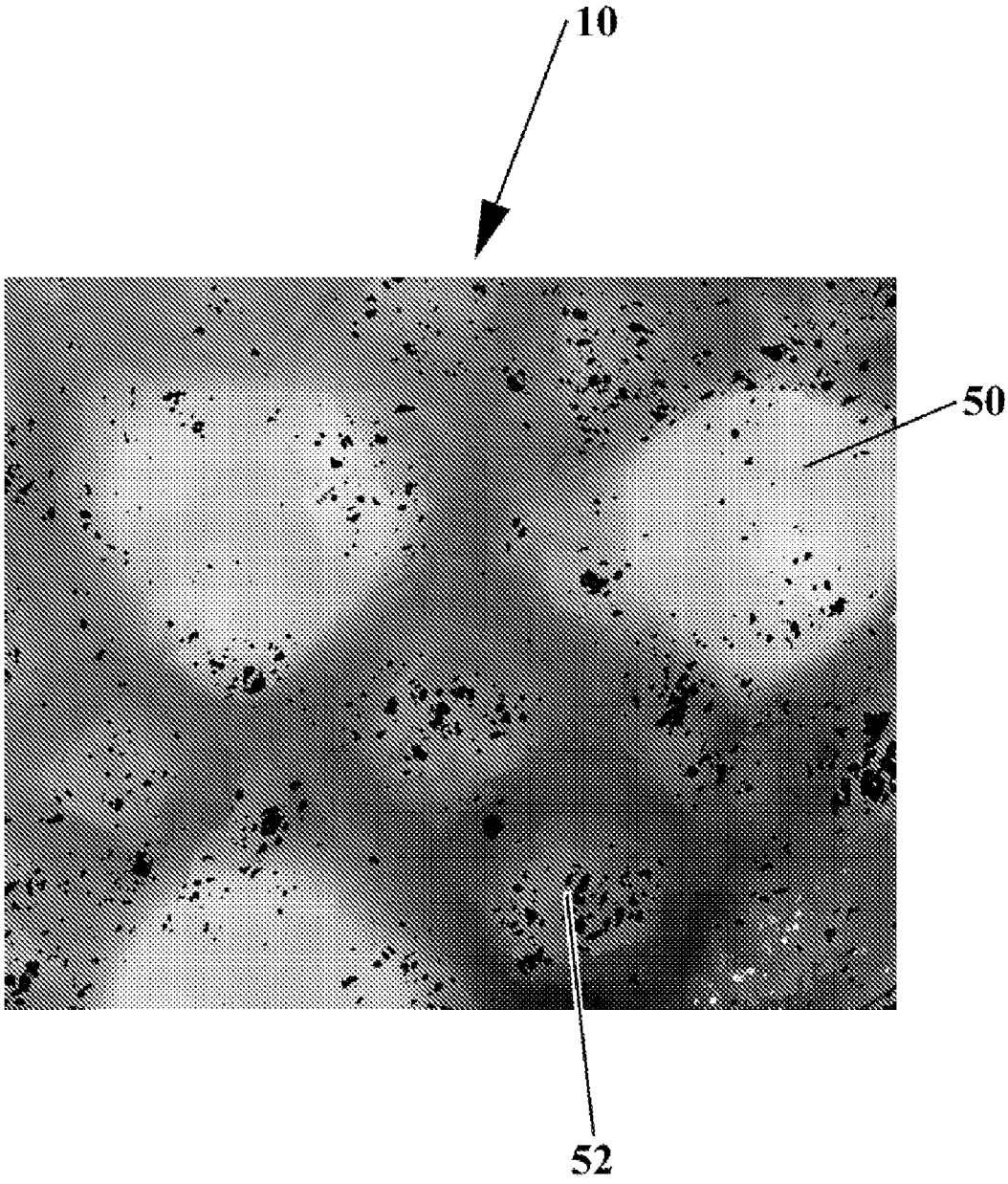
FIG. 10A is a Micro CT elevation, or top layer, image of a portion of the top layer of one embodiment of the cellulosic fibrous structure product having embossed and formed surface features.

FIG. 10A shows a Micro CT elevation, or top layer, image at 2048×2048 pixels and 10 micron resolution of the top layer of an exemplary cellulosic fibrous structure 10 having formed surface features 52 in addition to embossed surface features 50.

Figure 9B:
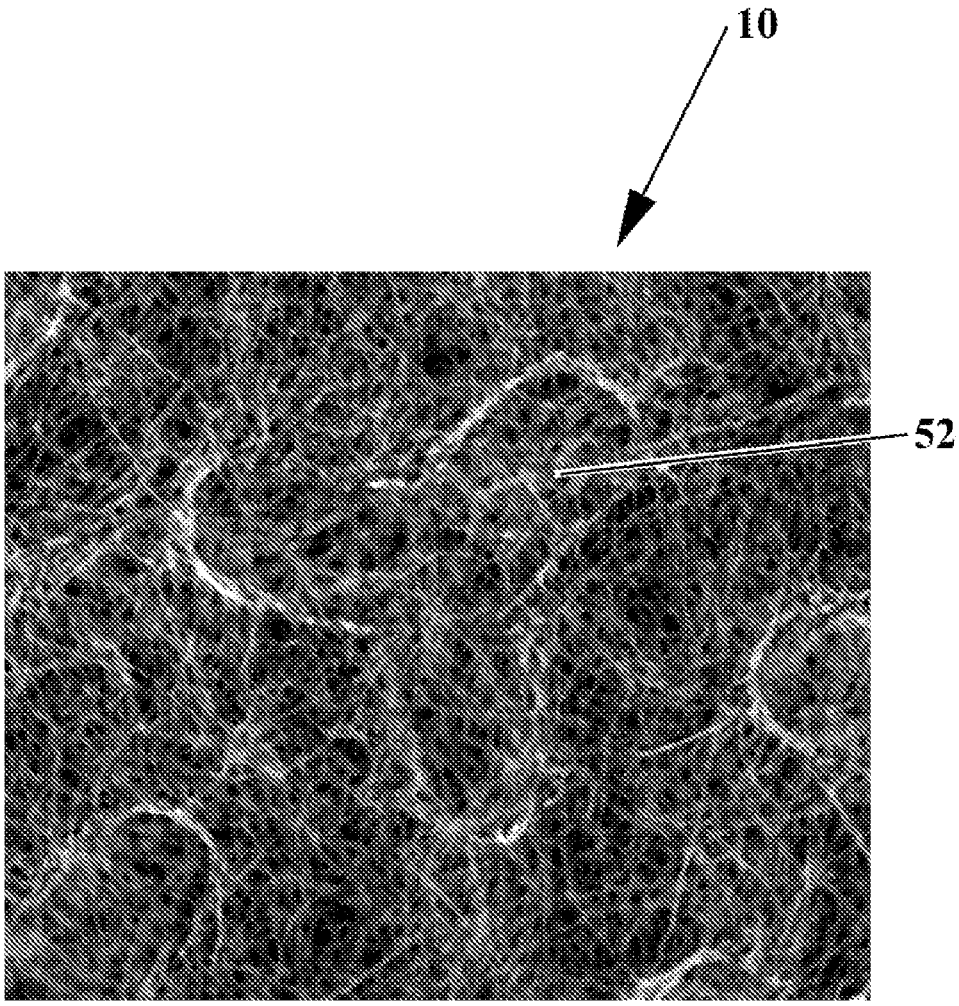
FIG. 9B is a Micro CT basis weight image of a portion of the cellulosic fibrous structure product of FIG. 9A.
Figure 10B:
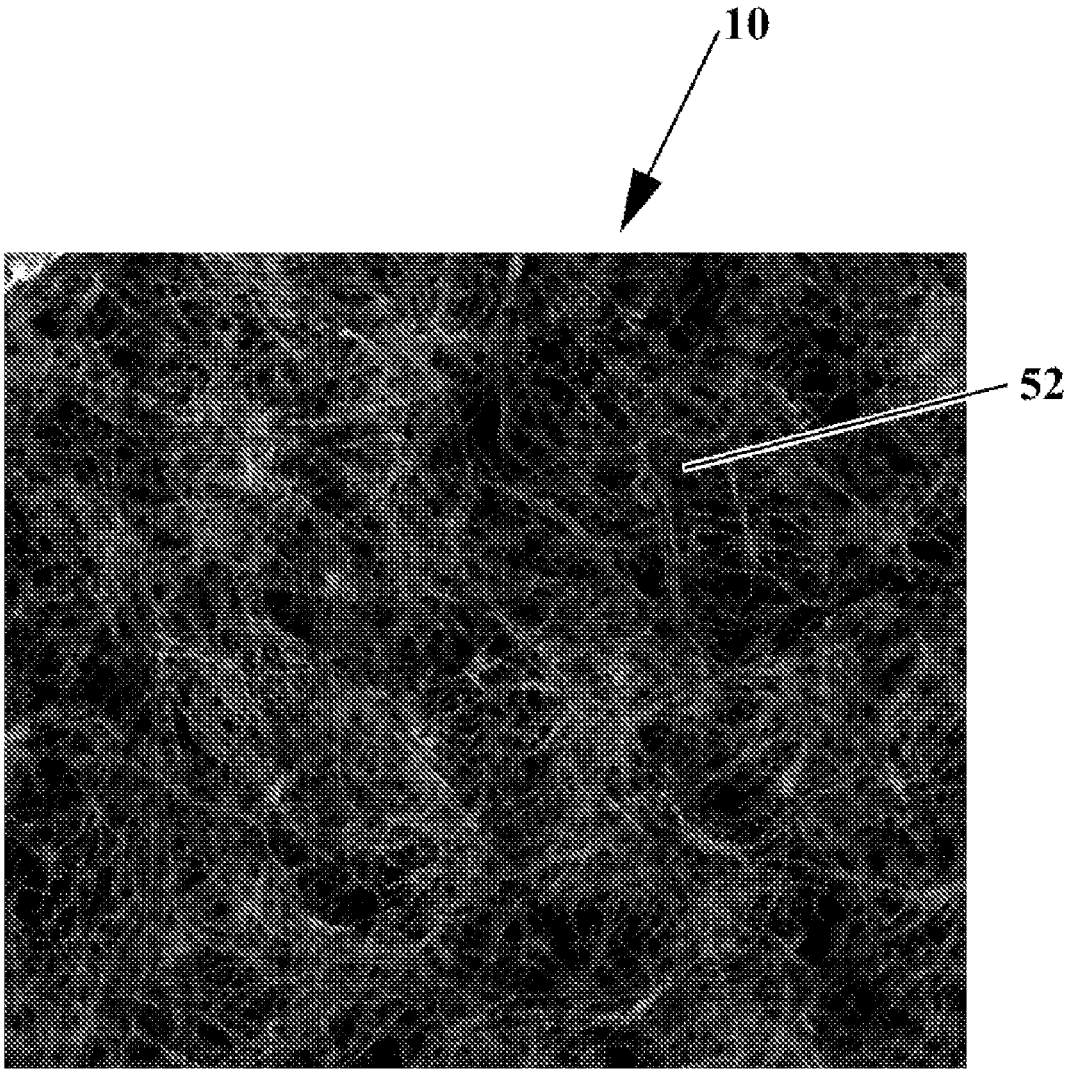
FIG. 10B is a Micro CT basis weight image of a portion of the cellulosic fibrous structure product of FIG. 10A.

FIGS. 9B and 10B show Micro CT basis weight images at 2048×2048 pixels and 10 micron resolution of the sum of all layers of the exemplary cellulosic fibrous structure 10 of FIGS. 9A and 10A, respectively. Clearly, the formed features 52 show a higher density "halo" around the edges of the feature, indicating higher localized basis weight surrounding the feature 52 than the embossed features 50, which show no "halo" in the image. Thus, the surface features which are formed in the wet-end of the papermaking process are structurally distinct from embossed features made in the dry end (i.e., converting) of the papermaking process.

Micro CT

Visualization of Relative Basis Weights:

Micro CT provides a visual depiction of the relative basis weight of different regions of the cellulosic fibrous structure product in the Z-direction using X-rays. One of skill in the art will appreciate that the described methodology is exemplary and nonlimiting.

As described herein, Micro CT reports the X-ray absorption of a sample specimen in the three-dimensional Cartesian coordinates system. The obtained 3D dataset is thus analyzed via Matlab® image processing software application to determine the relative basis weight of the 3D material structures extending outwardly beyond the reference level of the application substrate.

Micro-Tomography:

The sample specimen is irradiated with X-rays. The radiation transmitted through the sample is collected into an X-ray scintillator to transform the X-rays into electromagnetic radiations readable by the CCD elements of an array camera. The obtained 2D image, also referred to as a "projected image" or "shadow image", is not sufficient alone to determine independently the X-ray absorption specific for each volume elements (voxels) located along the transmission lines of the X-rays radiated from the source through the sample to the camera. To do so, several projected images taken from different angles are needed to reconstruct the 3D space. The sample specimen is thus rotated (either 180° or 360°) with the smallest possible rotation steps to increase precision. Additional corrections eliminate the positive blur in the back projection process and the distortions induced by the cone beam geometry associated with using a 2D detector.

Equipment:

A high resolution desktop X-ray micro-tomography instrument (e.g. Scanco μCT 40);

A 3D dataset analysis (e.g. a high performance computer to run Matlab®+Image Processing Toolbox).

Test Procedure:

1. Sample Preparation

A 20 mm disc is cut from the substrate sample containing the 3D material structures of interest. For 2ply paper products, the plies are carefully separated after cutting down to the correct sample size. Great care must be applied to avoid any laminate stretch or deformation. The sample specimen is posititioned horizontally between two 20.5 mm diameter Styrofoam rings inside a 20.5 mm inner diameter sample tube. This positioning allows for analysis of a small area in the center of the sample, with no interference from other materials.

2. Scanning Parameters

For the Scanco μCT 40 scanner, the peak voltage of the X-ray source is 35 kVp, the source current is 110 μA, the pixel size is 10 μm, number of slices obtained varied based on sample thickness, typical settings were between 200-377 slices. The sample rotation cycle is 360°, the rotating step is 0.18°, the beam exposure time at each rotating step is 300 ms, the frame averaging for signal-to-noise reduction is 10. The lowest energy X-rays are filtered through 300 μm Aluminum. No random movement to reduce ring artefacts is applied.

3. Reconstruction Protocol

The 3D dataset is reconstructed from the projected images obtained at each rotating steps as 2048×2048 pixels matrix per each depth slice, each pixel containing the X-ray absorption in 16 bit depth format. The pixel size is maintained at 10 μm. Noise smoothing is set as low as possible. Additional post-processing ring artefacts reduction is not required or set to minimum. No X-ray beam hardening correction is required on low X-ray absorbing material or set to minimum.

4. 3D Image Analysis

The Data File:

The CT instrument scans a sample and produces a volume image. One of skill in the art will appreciate that the volume image can be thought of as a 3 dimensional representation of the density of the sample wherein the density of the sample is related to the x-ray absorptance of the material. One of skill in the art will also appreciate that by taking numerous x-ray images all the way around the sample, the instrument can reconstruct this into a volume image of the density of the image.

Without wishing to be limited by theory, it is thought that the image can be thought of as a 3-dimensional array of numbers. Each element of this array can be thought of as being spatially representing the density of the sample at the same position in the image. For example, if a volume image is created that has 1000 elements laterally in both the x and y direction, and 100 elements vertically in the z, or depth, dimension, then element (x=200, y=300, z=40) would represent a point in the sample that is 20% over (within the field of view) in the direction, 30% over in the direction, and 40% deep in the direction. Each element is called a "voxel" (derived from "volume element"). If data from a single depth is being considered, this 2 dimensional array is called a "slice." Voxels that are within a slice are commonly called "pixels" as is the standard for 2-dimensional images in the image processing field, although they could be called voxels as well. The value of the voxel or pixel is often called "gray level."

The image consists of a data file with a format that is designed by the CT instrument manufacturer. The file extension for this format is ".isq." The data in the file begins with of a header that describes information about the volume image, such as number of voxels in the x, y, and z direction, the number of data bits per voxel, etc. The voxel values follow the header and are written slice-by-slice, that is, all the voxels of slice 1 are written first, followed by all the voxels of slice 2, etc.

Image Analysis—Image Generation

The image analysis consists of going through the volume image slice by slice to create 2-dimensional images that represent several features along the z, or thickness, direction:

1. The "mass density" of the sample. This is the "basis weight" of the sheet, or the mass per unit area. By using some calibration coefficient that we input, the image has units of grams per square meter.
2. The top layer image. This is elevation or topographical data, or the height of the outermost top surface of the sheet above a flat reference such as a table top.
3. The bottom layer image. This is the top layer except for the bottom surface of the sheet.
4. The thickness of the sheet. This is simply the top layer minus the bottom layer. The result is an image which is the thickness of the sheet at any point in the 2-dimensional field of view.
5. The "volume density" of the sample. This is density described in mass per unit volume. This may be derived by dividing the basis weight image by the thickness image.

The above images are built up according to the following methodology:

1. A volume image file is selected by the user for analysis.
2. The user visually determines starting and ending slice.
3. The user specifies a threshold that determines how dense a voxel needs to be before it is considered as part of the sample. This eliminates noise in empty spaces of image that would otherwise be considered as material. One of skill in the art will appreciate that a proper threshold ensures nice contrast in the final images by eliminating a noisy "fog" that would otherwise reduce the contrast.
4. The user enters a slope value and an offset value as calibration factors. The basis weight image will use these to convert it into real world units of grams per square meter. The default value of the slope is 1 and the default value of the offset is 0. If the user leaves these values as is, then the values for basis weight would be the same as the voxel values.
5. A slice is read from the volume image data file. The number of this slice is recorded for future reference.
6. The slice is thresholded so that values below the threshold are set to zero and those equal to or above the threshold are maintained at their original values.
7. This thresholded slice image is added to a cumulative image that is being built up for the basis weight image.
8. This thresholded slice image is compared to a cumulative image that is being built up for the top layer. Each pixel in the top layer image is examined:
   a. If the top layer image is zero at a pixel, and the slice image pixel is above the threshold, then the top layer pixel value is set to the slice number.
   b. If the top layer image pixel already has a value (i.e., from a prior slice) the pixel value is not changed. Without wishing to be limited by theory, it is thought that in doing so, the top layer image can record the slice level at which material first appeared. For example, if a top layer pixel is 0, and the slice image pixel is above the threshold, and we are at slice #74 then the pixel value will be set to 74.
9. For the bottom layer image, the image must already have a pixel set in the top layer image before we can set the bottom layer elevation. The threshold slice image is also compared to a cumulative image that is being built up for the top layer. Each pixel in the top layer image is examined:
   a. If the top layer image is zero at a pixel, and the slice image pixel is above the threshold, then the pixel value of the bottom layer is left at 0.
   b. If the top layer image pixel already has a value (meaning that we are now within the sample) the pixel value is set to the current slice number. For example if the top layer pixel value was 30 (material first appeared at slice 30), and we are at slice #93 then the bottom pixel value will be set to 93. It may continue to have the value (for this pixel column) incremented until we finally leave the material.

The bottom layer image will continue to have its pixels incremented as long as we are still within the material. In this way the bottom layer image can record the slice level at which material last appeared, and columns that had no material at all throughout the depth will have value 0.
10. Go back to step 4 and repeat until we have reached the ending slice as specified in step 2.
11. The thickness image is determined by subtracting the top layer image (Step 8) from the bottom layer image (Step 9).
12. The basis weight image is determined by multiplying the image by the slope value and adding the offset value, as specified by the calibration inputs (Step 4). If the user left the default values of 1 for the slope and 0 for the offset, then the basis weight image pixel values will be reported as gray levels (which is the voxel value or intensity).
13. The volume density image is determined by dividing the basis weight image (Step 12) by the thickness image (Step 11).

Image Analysis—Region of Interest Measurement

The user can then inspect sub-regions of the above 5 images:

1. The Basis Weight image
2. The Thickness image
3. The Top Layer image

4. The Bottom Layer image
5. The Volume Density image

This is done as follows:

1. The user can specify which one of the 5 images is displayed.
2. The user selects one of three radio buttons. These radio buttons can be given a label that describes the type of region, for example "Thick," "Thin," and "Transition."
3. The user interactively draws a polygon onto the displayed image.
4. The program measures the mean and standard deviation for all 5 images within the polygon region the user drew.
5. The user can optionally add a comment into a text box that describes the regions just drawn
6. The user clicks a button and a line is added to a cumulative data file that contains the filename, the region type (from Step 2), the user's comment (Step 5), and the 5 means and 5 standard deviations (Step 4).
7. The program also copies the region the user drew to a cumulative image that stores all the regions of a particular type (Step 2) that the user drew.
8. The user can repeat Steps 1-7 for as many regions as desired.

The results for all the region measurements are in a comma separated variable (CSV) file that can be opened with Microsoft Excel or any text editor. The 5 resulting images and the cumulative sub-region images (up to 3 of them) can also be visualized.

Liquid Absorption

Those of skill in the art will appreciate that consumers of cellulosic fibrous structure products often prefer a highly absorbent product. The amount of liquid that remains on a surface after being absorbed by a cellulosic fibrous structure product after a fixed amount of time may be expressed in terms of a Residual Water Value (g). Residual water may be measured using the "Residual Water Value Method" described below.

Figure 11A:
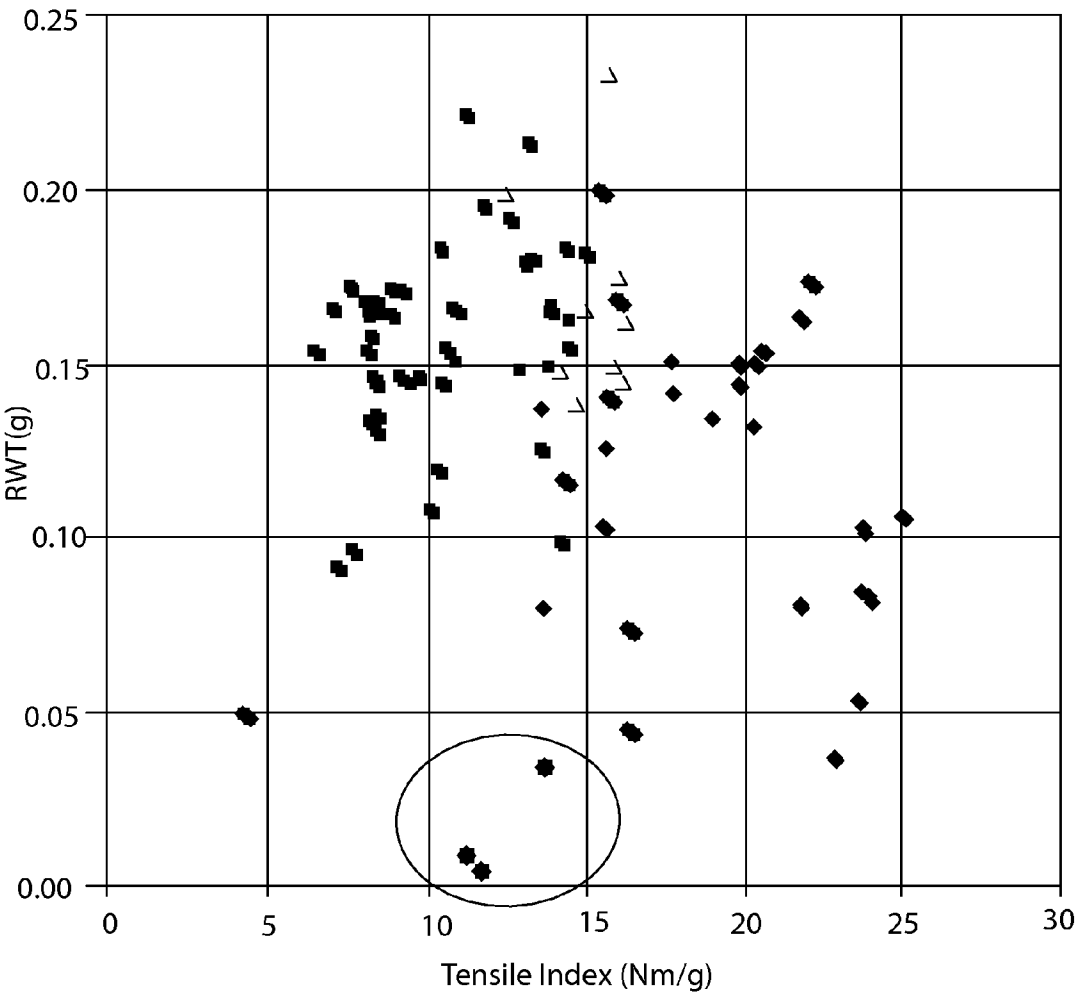
FIG. 11A is a graphical representation of the Residual Water Value versus Tensile Index of various products.
Figure 11B:
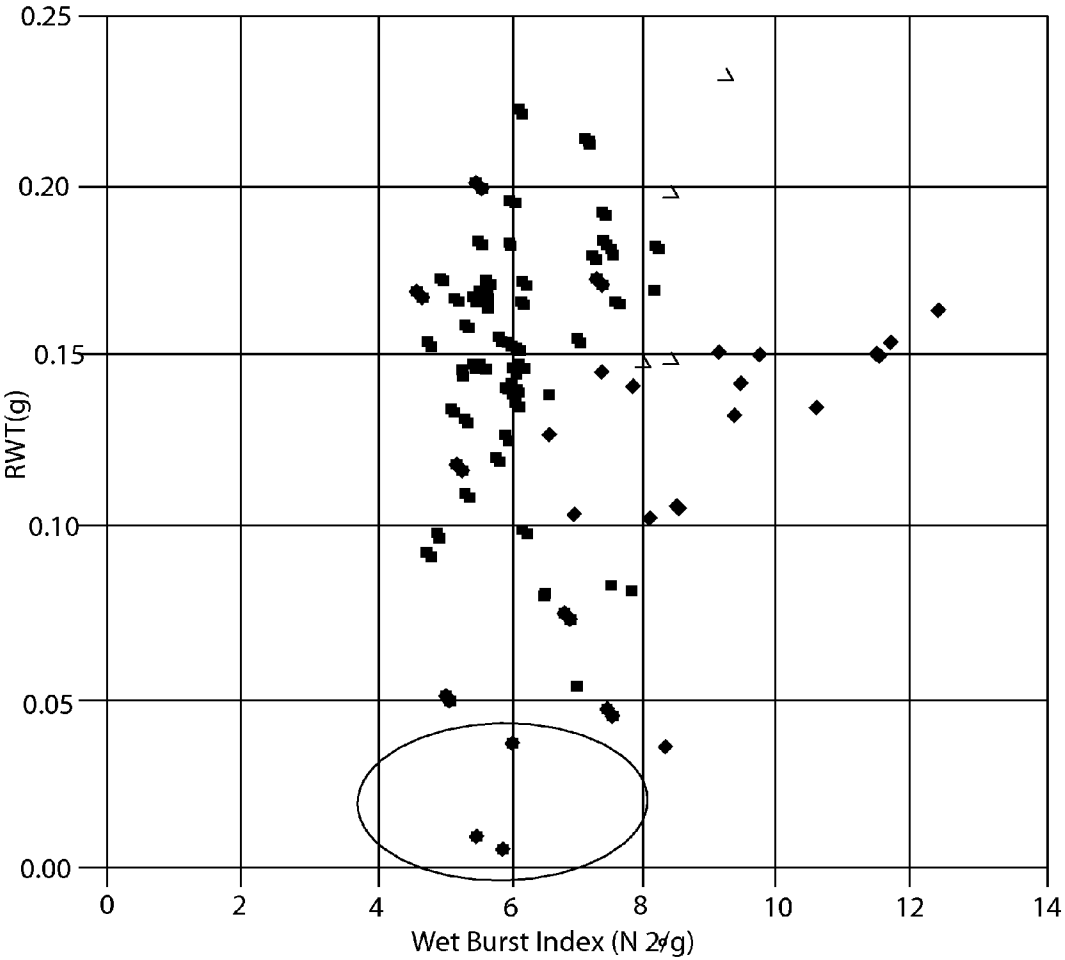
FIG. 11B is a graphical representation of the Residual Water Value versus Wet Burst Index of various products.

It is known in the art that increasing the basis weight of a product, the amount of water that can be retained after a specific period of time will also increase. In addition, it is known in the art that increasing the basis weight of the product will also increase the tensile strength of the product. However, there are a number of drawbacks associated with making a cellulosic fibrous structure product having a very high basis weight. For example, increased cost or an unduly stiff product may deter consumers from purchasing the product, despite the product having a high absorbency. The Dry Tensile Index, which is the ratio of Total Dry Tensile Strength (as is measured according to the "Dry Tensile Test Method" described below) to Basis Weight (as is measured according to the "Basis Weight Method" described below) may be used as a gauge of relative strength-to-fiber content. Similarly, Wet Burst Index, which is the ratio of Wet Burst Strength (as is measured according to the "Wet Burst Test Method" described below) to Basis Weight (as is measured according to the "Basis Weight Test Method" described below) may also be used as an alternative gauge of relative strength-to-fiber content. FIGS. 11A and 11B graphically depict the RVW versus Tensile Index/Wet Burst Index, respectively, of samples of absorbent paper products made according to various prior art manufacturing techniques, prior art samples, and present invention samples. In both FIGS. 11A and 11B, the present invention samples having at least three microscopic surfaces are distinguished by the dotted circle surrounding those points.

Surprisingly, it was found that the amount of residual water on a surface after using a cellulosic fibrous structure having at least three macroscopic surfaces is lower than the amount of residual water on a surface after using a cellulosic fibrous structure having two or fewer macroscopic surfaces for cellulosic fibrous structure products within particular Dry Tensile Index limits. In one embodiment, the Dry Tensile Index is less than about 20 Nm/g. In another embodiment, the Dry Tensile Index is from about 1 Nm/g to about 20 Nm/g. In another embodiment, the Dry Tensile Index is from about 10 Nm/g to about 15 Nm/g. Within the specified Dry Tensile Index ranges, the RWV is less than about 0.04 g as measured by the Residual Water Value Method described below. In another embodiment, the RWV is from about 0 to about 0.04 g. In another embodiment, the RWV is from about 0.01 g to about 0.04 g.

Also surprisingly, it was found that the amount of residual water on a surface after using a cellulosic fibrous structure having at least three macroscopic surfaces is lower than the amount of residual water on a surface after using a cellulosic fibrous structure having two or fewer macroscopic surfaces for cellulosic fibrous structure products within particular Wet Burst Index limits. In one embodiment, the Wet Burst Index is less than about 10 $Nm^2/g$. In another embodiment, the Wet Burst Index is from about 2 $Nm^2/g$ to about 10 $Nm^2/g$. In another embodiment, the Wet Burst Index is from about 5 $Nm^2/g$ to about 7 $Nm^2/g$. Within the specified Wet Burst Index ranges, the RWV is less than about 0.04 g as measured by the Residual Water Value Method described below. In another embodiment, the RWV is from about 0 to about 0.04 g. In another embodiment, the RWV is from about 0.01 g to about 0.04 g.

Dry Tensile Test Method

"Dry Tensile Strength" sometimes known to those of skill in the art as "Tensile Strength" of a fibrous structure, as used herein, is measured as follows: One (1) inch by four-and-a-half (4.5) inch (2.54 cm×11.43 cm) strips of fibrous structure and/or paper product comprising such fibrous structure are provided. The strip is equilibrated in a conditioned room at a temperature of 73° F.±2° F. (about 22.8° C.±1° C.) and a relative humidity of 50%±2% for at least two hours. After the strip has been equilibrated, the strip is placed on an electronic tensile tester Model EJA 2000 commercially available from the Thwing-Albert Instrument Co., W. Berlin, N.J. The cross-head speed of the tensile tester is 4.0 inches per minute (about 10.16 cm/minute) and the gauge length is 4.0 inches (about 5.08 cm). The Dry Tensile Strength can be measured in any direction by this method. The resultant Dry Tensile Strength may be converted from units of g/in to N/m with the following conversion: Dry Tensile Strength (g/in)*0.3860886=Dry Tensile Strength (N/m). The "Total Dry Tensile Strength" or "TDT" is the special case determined by the arithmetic total of MD and CD tensile strengths of the strips.

Wet Burst Test Method

"Wet Burst Strength" as used herein is a measure of the ability of a fibrous structure and/or a fibrous structure product incorporating a fibrous structure to absorb energy, when wet and subjected to deformation normal to the plane of the fibrous structure and/or fibrous structure product.

Wet burst strength may be measured using a Thwing-Albert Burst Tester Cat. No. 177 equipped with a 2000 g load cell commercially available from Thwing-Albert Instrument Company, Philadelphia, Pa.

Wet burst strength is measured by taking two fibrous structure product samples. Using scissors, cut the samples in half in the MD so that they are approximately 228 mm in the machine direction and approximately 114 mm in the cross machine direction. First, condition the samples for two (2) hours at a temperature of 73° F.±2° F. (about 23° C.±1° C.) and a relative humidity of 50%±2%. Next age the samples by stacking the samples together with a small paper clip and "fan" the other end of the stack of samples by a clamp in a 105° C. (±1° C.) forced draft oven for 5 minutes (±10 seconds). After the heating period, remove the sample stack from the oven and cool for a minimum of three (3) minutes before testing. Take one sample strip, holding the sample by the narrow cross machine direction edges, dipping the center of the sample into a pan filled with about 25 mm of distilled water. Leave the sample in the water four (4) (±0.5) seconds. Remove and drain for three (3) (±0.5) seconds holding the sample so the water runs off in the cross machine direction. Proceed with the test immediately after the drain step. Place the wet sample on the lower ring of a sample holding device of the Burst Tester with the outer surface of the sample facing up so that the wet part of the sample completely covers the open surface of the sample holding ring. If wrinkles are present, discard the samples and repeat with a new sample. After the sample is properly in place on the lower sample holding ring, turn the switch that lowers the upper ring on the Burst Tester. The sample to be tested is now securely gripped in the sample holding unit. Start the burst test immediately at this point by pressing the start button on the Burst Tester. A plunger will begin to rise toward the wet surface of the sample. At the point when the sample tears or ruptures, report the maximum reading. The plunger will automatically reverse and return to its original starting position. Repeat this procedure on three (3) more samples for a total of four (4) tests, i.e., four (4) replicates. Report the results as an average of the four (4) replicates, to the nearest g.

Basis Weight Method

Basis weight is measured by preparing one or more samples of a certain area ($m^2$) and weighing the sample(s) of a fibrous structure according to the present invention and/or a fibrous structure product comprising such fibrous structure on a top loading balance with a minimum resolution of 0.01 g. The balance is protected from air drafts and other disturbances using a draft shield. Weights are recorded when the readings on the balance become constant. The average weight (g) is calculated and the average area of the samples ($m^2$). The basis weight ($g/m^2$) is calculated by dividing the average weight (g) by the average area of the samples ($m^2$). This method is herein referred to as the Basis Weight Method.

Residual Water Value (RWV) Method

This method measures the amount of distilled water absorbed by a paper product. In general a finite amount of distilled water is deposited to a standard surface. A paper towel is then placed over the water for a given amount of time. After the elapsed time the towel is removed and the amount of water left behind and amount of water absorbed are calculated.

The temperature and humidity are controlled within the following limits:

Temperature: 23° C.±1° C. (73° F.±2° F.)

Relative humidity: 50±2%

The following equipment is used in this test method. A top loading balance is used with sensitivity: ±0.01 grams or better having the capacity of grams minimum. A pipette is used having a capacity of 5 mL and a Sensitivity±1 mL. A Formica™ Tile 6 in×7 in is used. A stop watch or digital timer capable of measuring time in seconds to the nearest 0.1 seconds is also used.

Sample and Solution Preparation

For this test method, distilled water is used, controlled to a temperature of 23° C.±1° C. (73° F.±2° F.) (must pass Analytical Method I-K-1 Distilled Water Quality.) For this method, a useable unit is described as one finished product unit regardless of the number of plies. Condition the rolls or useable units of products, with wrapper or packaging materials removed in a room conditioned at 50+2% relative humidity, 23° C.±1° C. (73°±2° F.) for a minimum of two hours. Do not test useable units with defects such as wrinkles, tears, holes etc.

Paper Samples

Remove and discard at least the four outermost useable units from the roll. For testing remove useable units from each roll of product submitted as indicated below. For Paper Towel products, select five (5) usable units from the roll. For Paper Napkins that are folded, cut and stacked, select five (5) useable units from the sample stack submitted for testing. For all napkins, either double or triple folded, unfold the useable units to their largest square state. One-ply napkins will have one 1-ply layer; 2-ply napkins will have one 2-ply layer. With 2-ply napkins, the plies may be either embossed (just pressed) together, or embossed and laminated (pressed and glued) together. Care must be taken when unfolding 2-ply useable units to keep the plies together. If the unfolded useable unit dimensions exceed 279 mm (11 inches) in either direction, cut the useable unit down to 279 mm (11 inches). Record the original useable unit size if over 279 mm. (11 inches). If the unfolded useable unit dimensions are less than 279 mm (11 inches) in either direction, record the useable unit dimensions.

Place the Formica Tile (standard surface) in the center of the cleaned balance surface. Wipe the Formica Tile to ensure that it is dry and free of any debris. Tare the balance to get a zero reading. Slowly dispense 2.5 mL of distilled water onto the center of the standard surface using the pipette. Record the weight of the water to the nearest 0.001 g. Drop 1 useable unit of the paper towel onto the spot of water with the outside ply down. Immediately start the stop watch. The sample should be dropped on the spot such that the spot is in the center of the sample once it is dropped. Allow the paper towel to absorb the distilled water for 30 seconds after hitting the stop watch. Remove the paper from the spot after the 30 seconds has elapsed. The towel must be removed when the stop watch reads 30 seconds±0.1 secs. The paper towel should be removed using a quick vertical motion. Record the weight of the remaining water on the surface to the nearest 0.001 g.

Calculations $$RWV\ \text{Average(g)} = \frac{\sum_{n=1}^{5}(\text{Amount of } H_2O \text{ Remaining(g)})}{n}$$

n=the number of replicates which for this method is 5.

Record the RWV to the nearest 0.001 g.

Wall Angle Measurement Method

The geometric characteristics of the cellulosic fibrous structure product of the present invention are measured using an Optical 3D Measuring System MikroCAD paper measurement instrument (the "GFM MikroCAD optical profiler instrument") and ODSCAD Version 4.14 software (GFMesstechnik GmbH, WarthestraβE21, D14513 Teltow, Berlin, Germany). The GFM MikroCAD optical profiler instrument includes a compact optical measuring sensor based on digital micro-mirror projection, consisting of the following components:

A) A DMD projector with 1024×768 direct digital controlled micro-mirrors.

B) CCD camera with high resolution (1280×1024 pixels).

C) Projection optics adapted to a measuring area of at least 160×120 mm.

D) Recording optics adapted to a measuring area of at least 160×120 mm;

E) Schott KL 1500 LCD cold light source.

F) A table stand consisting of a motorized telescoping mounting pillar and a hard stone plate;

G) Measuring, control and evaluation computer.

H) Measuring, control and evaluation software ODSCAD 4.14.

I) Adjusting probes for lateral (XY) and vertical (Z) calibration.

The GFM MikroCAD optical profiler system measures the height of a sample using the digital micro-mirror pattern projection technique. The result of the analysis is a map of surface height (Z) versus XY displacement. The system should provide a field of view of 160×120 mm with an XY resolution of 21 μm. The height resolution is set to between 0.10 μm and 1.00 μm. The height range is 64,000 times the resolution. To measure a fibrous structure sample, the following steps are utilized:

1. Turn on the cold-light source. The settings on the cold-light source are set to provide a reading of at least 2,800 on the display.
2. Turn on the computer, monitor, and printer, and open the software.
3. Verify calibration accuracy by following the manufacturer's instructions.
4. Select "Start Measurement" icon from the ODSCAD task bar and then click the "Live Image" button.
5. Obtain a fibrous structure sample that is larger than the equipment field of view and conditioned at a temperature of 73° F.±2° F. (about 23° C.±1° C.) and a relative humidity of 50%±2% for 2 hours. Place the sample under the projection head. Position the projection head to be normal to the sample surface.
6. Adjust the distance between the sample and the projection head for best focus in the following manner. Turn on the "Show Cross" button. A blue cross should appear on the screen. Click the "Pattern" button repeatedly to project one of the several focusing patterns to aid in achieving the best focus. Select a pattern with a cross hair such as the one with the square. Adjust the focus control until the cross hair is aligned with the blue "cross" on the screen.
7. Adjust image brightness by increasing or decreasing the intensity of the cold light source or by altering the camera gains setting on the screen. When the illumination is optimum, the red circle at the bottom of the screen labeled "I.O." will turn green.
8. Select "Standard" measurement type.
9. Click on the "Measure" button. The sample should remain stationary during the data acquisition.
10. To move the data into the analysis portion of the software, click on the clipboard/man icon.
11. Align the image to eliminate any tilt in the sample by selecting "Filter", "Align". Additional filtering of the image is achieved by selecting "Filter", "Median Filter". In the Median Filter window, select "Direction X+Y" in the "Direction" Box. In the "Mask (pixel)" box, set the size at 11 pixels for both the X and Y direction.
12. Click on the icon "Draw Cutting Lines." On the captured image, "draw" a cutting line that extends from the center of a pseudo pillow region (positive region) through the centers of two densified regions (negative region), ending on the center of a pseudo-pillow region. Draw additional lines in other regions of the image until 5 discrete lines have been drawn. Click on the icon "Show Sectional Line Diagram." This will produce a graph showing each of the five sectional lines created. The x-axis represents the total distance of the sectional line, the y-axis is the height of the features along that line. To save the (X,Y) data in a text file, select "File", "Export Data", assign a file name with .txt extension.
13. Using Microsoft Excel 2003 (Microsoft Corp., Redmond, Wash.), open the .txt file from the previous step by selecting "Data", "Import External Data", "Import Data". Once the correct file has been highlighted, select "Open". This will open a data import wizard. Select "delimited", "tab" as the file type, and click through the prompts to place the data into a new excel worksheet. The data will be organized into ten columns. The first column is the X-axis data for the first sectional line, the second column is the Y-axis data for the first sectional line. Columns 3 and 4 contain data for the second cross sectional line, Columns 5 and 6 for the third, etc.
14. To calculate the slope of the transition between the positive and adjacent negative regions, first identify the cells representing the center positive, non-densified, region and the negative, densified, regions of the sectional line. Plotting the data in a scatter plot can aid in identifying the positive and negative regions of the curve. The beginning of the transition zone is defined as the value where the difference between adjacent Y-axis values is greater than 0.01 mm. The end of the transition zone is defined as the value where the difference between adjacent Y-axis values is less than 0.01 mm. For each of the five sectional line, identify the (x,y) coordinates of the beginning and end of each transition zone on both sides of the center positive region, for a total of four coordinates, $(X_1,Y_1)$, $(X_2,Y_2)$. $(X_3,Y_3)$, $(X_4,Y_4)$. One example in FIG. 6.
15. Calculate the ΔX, ΔY, and slope for each transition using the following equations:

$$\Delta X_A = X_2 - X_1$$

$$\Delta X_B = X_4 - X_3$$

$$\Delta Y_A = Y_2 - Y_1$$

$$\Delta Y_B = Y_3 - Y_4$$

$$\text{Slope } A = \Delta Y_A / \Delta X_A$$

$$\text{Slope } B = \Delta Y_B / \Delta X_B$$

16. The reported slope for each sample is the mathematical mean of the ten calculated slope values (five Slope A and five Slope B). The reported ΔY for each sample is the mathematical mean of the ten calculated Δvalues. Δis the height of the transition region.
17. Calculate the Arc Tan (in degrees) of the reported slope for each sample and subtract that value from 180 degrees. The resultant value is the wall angle.

All measurements referred to herein are made at 23±1° C. and 50% relative humidity, unless otherwise specified.

All publications, patent applications, and issued patents mentioned herein are hereby incorporated in their entirety by reference. Citation of any reference is not an admission regarding any determination as to its availability as prior art to the claimed invention.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A cellulosic fibrous structure product comprising:

one or more plies wherein at least one of the plies comprises one or more unembossed areas;

wherein at least one unembossed area comprises a macroscopic first surface and a macroscopic second surface;

wherein the fibrous structure product further comprises a first wall which forms vertices with the macroscopic first surface and the macroscopic second surface; and wherein the first wall and the macroscopic second surface form a top side wall angle of from about 90° to about 140° the fibrous structure product further comprising a bottom side first wall and a bottom side macroscopic first surface wherein the bottom side first wall and bottom side macroscopic first surface form a bottom side wall angle of about 90° to about 140°;

wherein the top side wall angle and the bottom side wall angle are not equivalent.

2. The cellulosic fibrous structure product of claim 1 wherein the top side wall angle is from about 90° to about 110°.

3. The cellulosic fibrous structure product of claim 1 wherein the bottom side wall angle is from about 90° to about 110°.

4. The cellulosic fibrous structure product of claim 1 further comprising an embossing pattern.

5. The cellulosic fibrous structure product of claim 1 further comprising a pillow region formed below the first surface and a densified region formed below the second surface, wherein the density of the densified regions is greater than or equal to the density of the pillow region.

6. The cellulosic fibrous structure product of claim 1 wherein the first surface is selected from the group consisting of continuous, semicontinuous, discontinuous, or combinations thereof.

7. The cellulosic fibrous structure of claim 1 further comprising a transition region, wherein the height of the transition region is greater than about 0.35 mm and the ratio of the slope of the transition region to the height of the transition region is from about 2.0 to about 4.0.

8. The cellulosic fibrous structure product of claim 1 wherein the Wet Burst Index is from about 2 $Nm^2/g$ to about 10 $Nm^2/g$.

9. The cellulosic fibrous structure product of claim 1 wherein the RWV is from about 0.01 g to about 0.04 g.

10. A cellulosic fibrous structure product comprising:

one or more plies wherein at least one of the plies comprises one or more unembossed areas;

wherein at least one of the unembossed areas further comprises a macroscopic first surface and a macroscopic second surface;

wherein the unembossed area further comprises a first wall which forms vertices with the macroscopic first surface and the macroscopic second surface; and wherein the first wall and the macroscopic second surface form a top side wall angle of from about 90° to about 140° wherein the macroscopic second surface comprises from about 10% to about 45% of the total surface area of each ply that is defined by a repeatable pattern;

the fibrous structure product further comprising a bottom side first wall and a bottom side macroscopic first surface wherein the bottom side first wall and bottom side macroscopic first surface form a bottom side wall angle of about 90° to about 140°;

wherein the top side wall angle and the bottom side wall angle are not equivalent.

11. The cellulosic fibrous structure product of claim 10 wherein the top side wall angle is from about 90° to about 110°.

12. The cellulosic fibrous structure product of claim 10 further comprising an embossing pattern.

13. The cellulosic fibrous structure product of claim 10 wherein the Wet Burst Index is from about 2 $Nm^2/g$ to about 10 $Nm^2/g$.

14. The cellulosic fibrous structure product of claim 10 wherein the RWV is from about 0.01 g to about 0.04 g.

* * * * *

UNITED STATES PATENT AND TRADEMARK OFFICE

CERTIFICATE OF CORRECTION

PATENT NO. : 7,799,411 B2
APPLICATION NO. : 11/924714
DATED : September 21, 2010
INVENTOR(S) : Ostendorf et al.

It is certified that error appears in the above-identified patent and that said Letters Patent is hereby corrected as shown below:

In Col. 15, line 15, the letter y should be added preceding the word "direction"

In Col. 15, line 16, the letter x should be added preceding the word "direction"

Signed and Sealed this

Twenty-first Day of December, 2010

David J. Kappos

David J. Kappos
*Director of the United States Patent and Trademark Office*